US008991598B2

(12) United States Patent
Whitworth

(10) Patent No.: US 8,991,598 B2
(45) Date of Patent: Mar. 31, 2015

(54) SYSTEM FOR STORING DEVICES WITH ELONGATED SHAFTS

(76) Inventor: Casey C. Whitworth, Mackay, ID (US)

( * ) Notice: Subject to any disclaimer, the term of this patent is extended or adjusted under 35 U.S.C. 154(b) by 199 days.

(21) Appl. No.: 13/354,930

(22) Filed: Jan. 20, 2012

(65) Prior Publication Data

US 2013/0105341 A1 May 2, 2013

Related U.S. Application Data

(60) Provisional application No. 61/553,022, filed on Oct. 28, 2011.

(51) Int. Cl.

| | |
|---|---|
| ***A63B 55/00*** | (2006.01) |
| *A63B 71/00* | (2006.01) |
| *A63B 71/06* | (2006.01) |

(52) U.S. Cl.

CPC ..... *A63B 55/00* (2013.01); *A63B 71/0045* (2013.01); *A63B 55/005* (2013.01); *A63B 55/008* (2013.01); *A63B 2055/002* (2013.01); *A63B 2071/0694* (2013.01); *A63B 2209/10* (2013.01)

USPC ..... 206/315.6; 206/315.1; 206/315.2; 206/315.3; D3/255; D3/261; 280/47.18

(58) Field of Classification Search

USPC ..... 206/315.1, 315.2, 315.3, 315.6; 280/47.18, 47.19, 47.26, 655; D3/255

See application file for complete search history.

(56) References Cited

U.S. PATENT DOCUMENTS

| | | | | | |
|---|---|---|---|---|---|
| 1,570,500 | A | * | 1/1926 | Kennedy | 206/315.6 |
| 2,551,780 | A | | 4/1951 | Wood | |
| 3,678,611 | A | * | 7/1972 | Files | 43/26 |
| 4,100,652 | A | | 7/1978 | Carlson | |
| 4,522,300 | A | * | 6/1985 | Hamblet | 206/315.4 |
| 4,664,382 | A | | 5/1987 | Palmer et al. | |
| 4,673,082 | A | | 6/1987 | Hemme | |
| 4,739,958 | A | * | 4/1988 | Sato | 248/96 |
| 4,767,001 | A | * | 8/1988 | Kim | 206/315.3 |
| 4,796,789 | A | * | 1/1989 | Willcocks | 224/581 |
| 4,836,565 | A | | 6/1989 | Catalo | |
| 4,852,896 | A | * | 8/1989 | Mills | 280/47.18 |
| 4,915,221 | A | | 4/1990 | Spangler | |
| 4,960,212 | A | | 10/1990 | Wu | |
| 4,968,048 | A | | 11/1990 | Lortie | |
| 5,002,185 | A | * | 3/1991 | Schurman | 206/315.4 |
| 5,029,703 | A | * | 7/1991 | Dulyea, Sr. | 206/315.3 |

(Continued)

FOREIGN PATENT DOCUMENTS

| | | |
|---|---|---|
| GB | 2278062 | 11/1994 |
| JP | 200352876 A | 2/2003 |

OTHER PUBLICATIONS

Golf Kart Kaddy, Inc., Product Information, Apr. 24, 2012, http://www.golfkartkaddy.com/, USA.

*Primary Examiner* — Fenn Mathew
*Assistant Examiner* — Cynthia Collado
(74) *Attorney, Agent, or Firm* — Buchanan Nipper

(57) ABSTRACT

A system for storing a device having an elongated shaft and a shank portion. The system having a body portion and a cover portion. The body portion having a sidewall portion defining an opening there-through. The cover portion having a generally open-ring shape. The cover portion having an open position and a closed position, where the cover portion closes at least a portion of the opening when in the closed position, and where the cover portion is spaced apart from the opening when in the open position.

14 Claims, 18 Drawing Sheets

(56) References Cited

U.S. PATENT DOCUMENTS

| | | | | | |
|---|---|---|---|---|---|
| 5,088,635 | A | | 2/1992 | Taylor et al. | |
| 5,168,992 | A | * | 12/1992 | Bowdy | 206/315.6 |
| 5,222,596 | A | * | 6/1993 | Jordan | 206/315.6 |
| 5,332,090 | A | | 7/1994 | Tucker | |
| 5,417,334 | A | | 5/1995 | Wu | |
| 5,551,561 | A | | 9/1996 | MacRae et al. | |
| 5,582,290 | A | * | 12/1996 | McCuaig et al. | 206/315.6 |
| 5,636,734 | A | | 6/1997 | Smith | |
| 5,730,285 | A | | 3/1998 | Sheehan | |
| D394,957 | S | | 6/1998 | Hsu et al. | |
| 5,860,519 | A | * | 1/1999 | Meyer et al. | 206/315.3 |
| 5,899,328 | A | | 5/1999 | Dulyea, Sr. | |
| 5,947,282 | A | * | 9/1999 | Merrill et al. | 206/315.6 |
| 6,196,432 | B1 | | 3/2001 | Aliano, Jr. | |
| 6,607,077 | B2 | | 8/2003 | Feeney | |
| 6,622,859 | B2 | | 9/2003 | Morgenstern | |
| 7,481,311 | B1 | | 1/2009 | Old | |
| D653,032 | S | | 1/2012 | Myers | |
| 2008/0135431 | A1 | | 6/2008 | Tan | |
| 2008/0302686 | A1 | | 12/2008 | Dylina et al. | |
| 2010/0294681 | A1 | | 11/2010 | Dylina et al. | |

* cited by examiner

SYSTEM FOR STORING DEVICES WITH ELONGATED SHAFTS

PRIORITY/CROSS-REFERENCE TO RELATED APPLICATIONS

This application claims the benefit of U.S. Provisional Application No. 61/553,022, filed 28 Oct. 2011, the disclosure of which is incorporated herein by reference.

TECHNICAL FIELD

The disclosure generally relates to the field of devices for storing devices with elongated shafts. Particular embodiments relate to bags for storing golf clubs.

BACKGROUND

Modern golf club bags have a number of drawbacks in the terms of design and utility. First and foremost is the way golf clubs must be inserted and extracted from a standard golf club bag to be used by the golfer. Virtually all golf club bags have one opening located at the top of the bag through which clubs are inserted and removed. When a golf club bag is placed on a golf cart raising it off the ground the height of the top opening is also raised, which can cause problems to insert and remove golf clubs for golfers that are shorter in height or have limited physical movement in their shoulders due to injury or medical conditions. It is virtually impossible for many golfers with these top opening bags to grab a golf club in one position with one hand and extract it. To grab a golf club just below the head and remove it from the bag requires the point at which the golfer is gripping the club to be raised almost seven to eight feet in the air. Therefore, the process usually requires two hands or almost a throwing motion upward and re-gripping the club at certain intervals in order to extract it from the top opening.

Some prior golf bag designs attempted to overcome this above drawback through incorporation of a permanent opening in the front of the golf bag. However, because the opening is permanent in nature, the golfer does not have the ability to close this opening for the purpose of keeping out the elements while on the golf course or keeping the golf clubs within the bag during travel or storage.

SUMMARY OF THE DISCLOSURE

Several exemplary systems for storing a device having an elongated shaft and a shank portion are described herein.

An exemplary system for storing a device having an elongated shaft and a shank portion comprises a body portion and a cover portion. The body portion being generally cylindrical in shape. The body portion comprising a closed bottom portion connected to an open top portion via a sidewall portion. The sidewall portion defines an opening there-through extending from the open top portion towards the closed bottom portion. The cover portion having a generally open-ring shape. The cover portion having an open position and a closed position. The cover portion closing at least a portion of the opening when in the closed position. The cover portion spaced apart from the opening when in the open position.

Optionally, the diameter of the cover portion is greater than the diameter of the body portion.

Optionally, the cover portion comprises a plurality of cover portions, and each of the plurality of cover portions close at least a portion of the opening when in the closed position.

Optionally, the bottom portion comprises a base means, a central portion and an interior bottom surface.

Optionally, the sidewall portion comprises an internal surface and an external surface.

Optionally, the sidewall portion is generally circular in shape vertically below the opening, and generally arc-shaped in cross-section vertically along the opening's vertical height.

Optionally, the opening defines a first edge opposite a second edge.

Optionally, the system comprises a body connector portion for connecting the cover portion to the body portion. Further optionally, the body connector portion comprises at least one track attached to the body portion which the cover portion travels around. Further optionally, the cover portion comprises a plurality of cover portions, wherein each of the plurality of cover portions close at least a portion of the opening when in the closed position, wherein the body connector portion connects adjacent cover portions together.

Optionally, the cover portion further comprises a handle for enabling a user to move the cover portion from the closed position to the open position.

Optionally, the system further comprises a support element for supporting the body portion, the support element connecting to the bottom portion of the body portion, the support element extending away from the bottom portion. Further optionally, the support element further comprises an open-ring shaped retention ring for supporting the top portion of the body portion. Further optionally, the support element is located on the opposite side of the body portion as the opening.

Optionally, the system further comprises a back plate connecting with the support element. Further optionally, a shoulder strap connects to the back plate.

Optionally, the body portion further comprises a horizontal shaft spacer portion adjacent the open top portion. Further optionally, the horizontal shaft spacer portion comprises shaft engaging means for receiving and retaining the shank portion of an elongated shaft. Further optionally, the horizontal shaft spacer portion comprises a series of retainer modules, each retainer module comprising an upper retainer, a bottom retainer, and a compressible planar disc received between the upper retainer and the bottom retainer. It is preferred that the planar disc is moveable side-to-side as well as being compressible.

Another exemplary system is for storing a device having an elongated shaft having an end portion. The system comprising a body. The body comprising a sidewall connecting between an open top and a closed bottom. The sidewall comprising an interior sidewall surface. The closed bottom comprising an interior base surface. The interior base surface comprising an upwardly extending a center spacer portion. The center spacer portion having a center surface. The center surface spaced apart from the interior sidewall surface and defining a retention channel there-between. The end portion configured for insertion into the body through the open top portion. The end portion configured for insertion into retention channel, held by a friction fit between the interior sidewall surface and the center surface.

Optionally, the center spacer portion has a generally curved cross-sectional shape.

Optionally, the center spacer portion has a generally conical cross-sectional shape.

Optionally, the center spacer portion has a generally frustoconical cross-sectional shape.

Optionally, the device is a golf club.

Additional understanding of the devices and methods contemplated and/or claimed by the inventor can be gained by reviewing the detailed description of exemplary devices and methods, presented below, and the referenced drawings.

DETAILED DESCRIPTION

Figure 1:
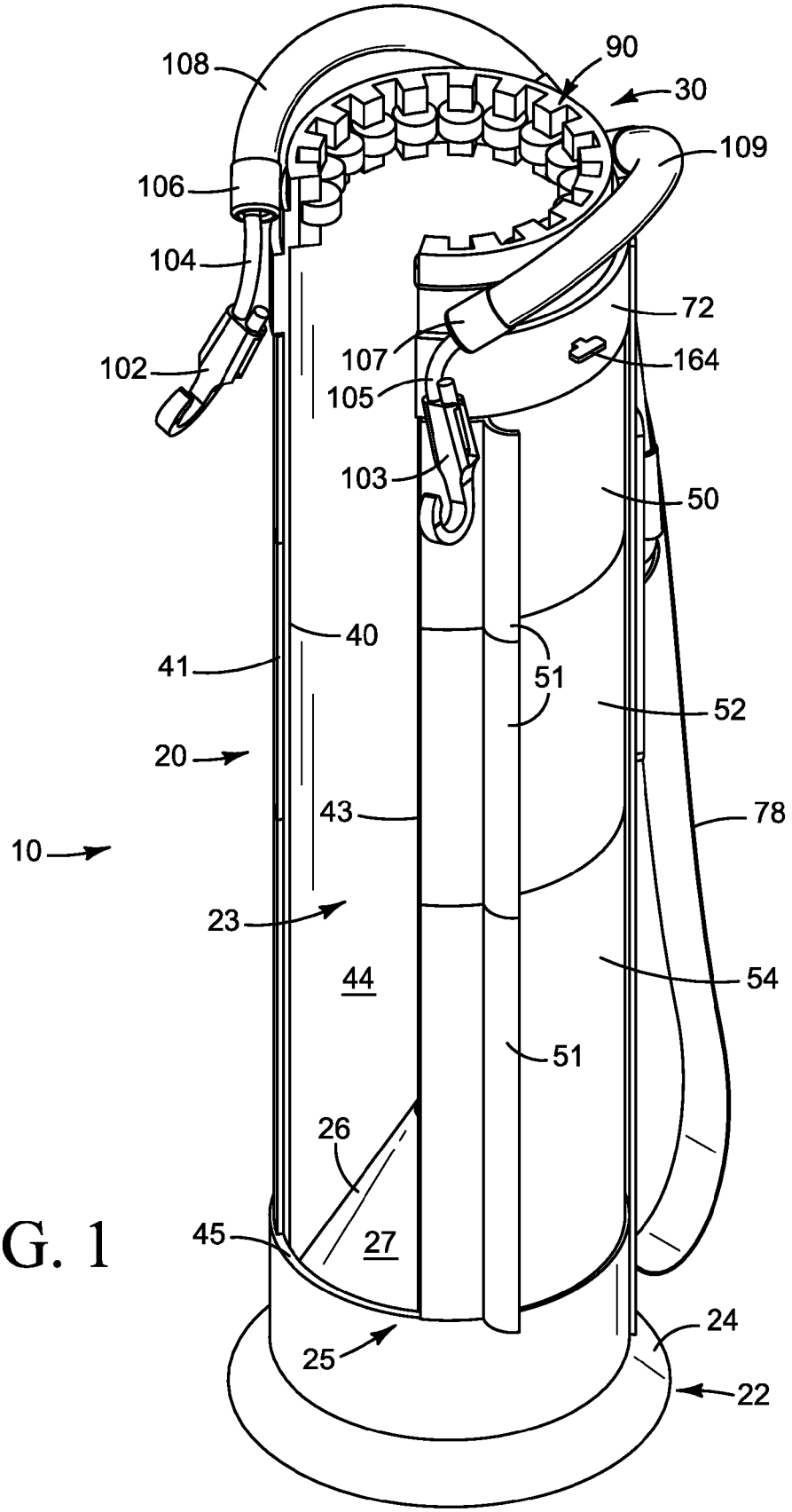
FIG. 1 is a first perspective view of a first exemplary system for storing devices with elongated shafts.
Figure 2:
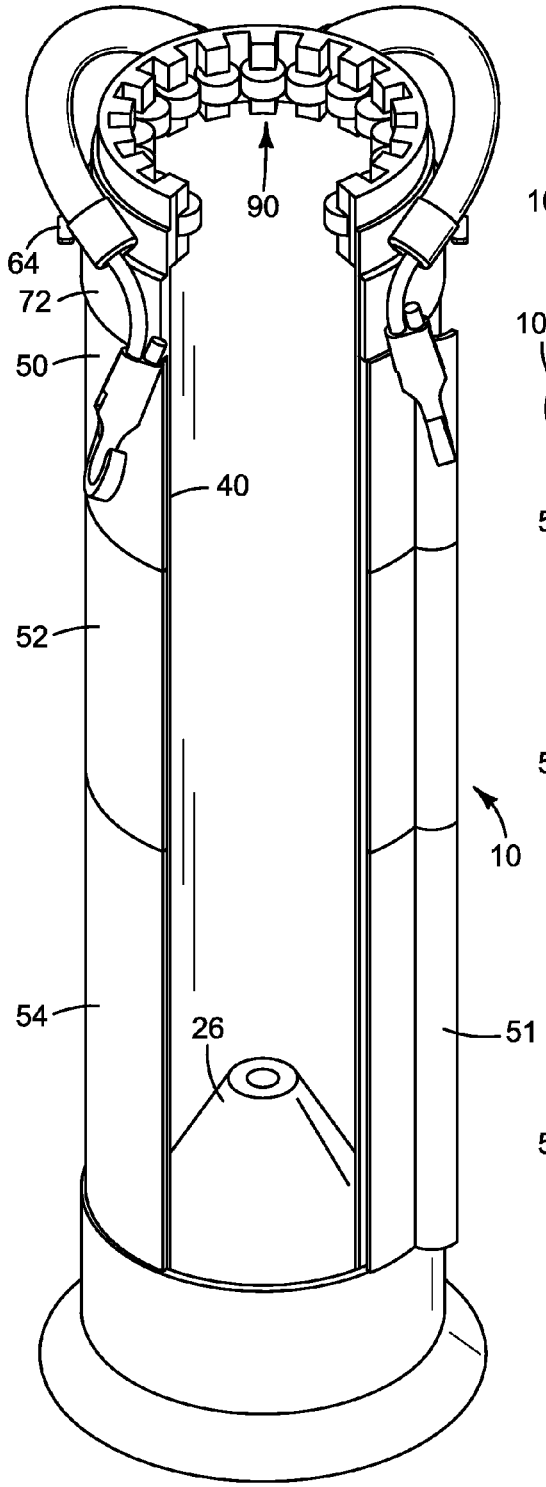
FIG. 2 is a second perspective view of the first exemplary system of FIG. 1.
Figure 3:
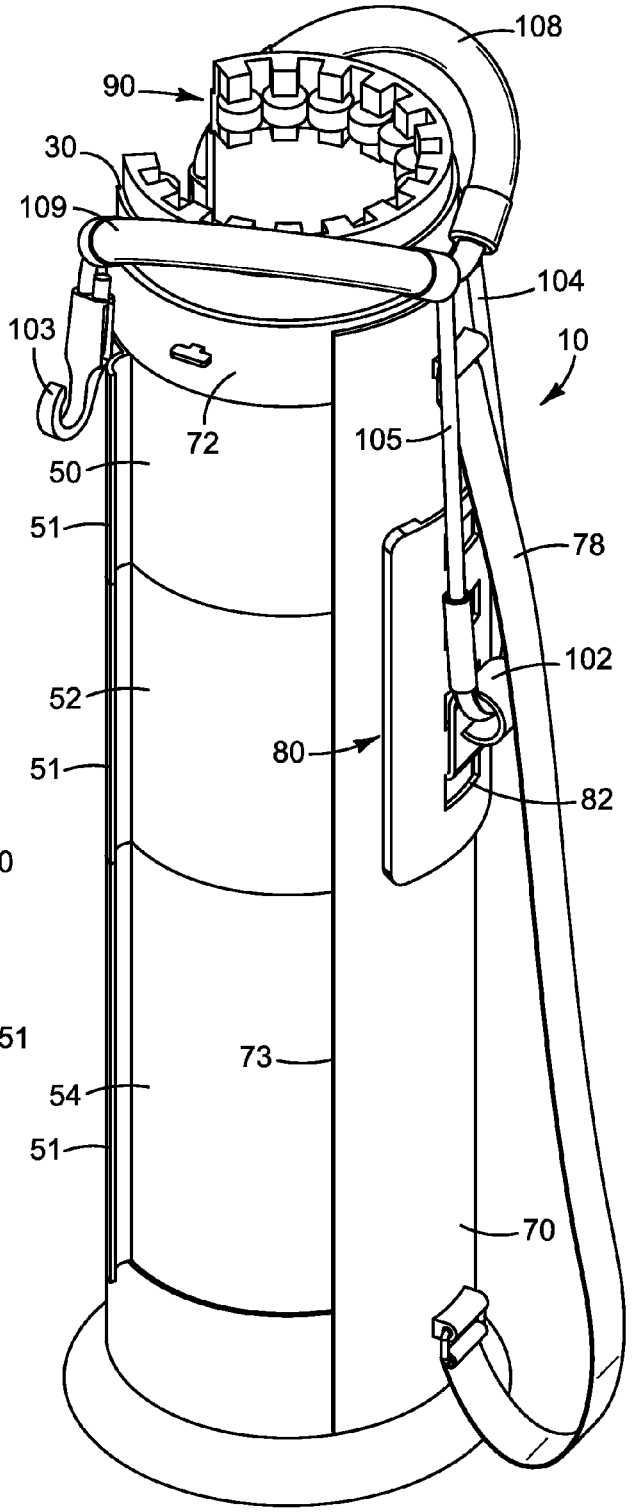
FIG. 3 is a third perspective view of the first exemplary system of FIG. 1.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," and "or" and grammatically related terms indicates non-exclusive alternatives without limitation, unless the context clearly dictates otherwise. The use of "including" and grammatically related terms means "including, but not limited to," unless the context clearly dictates otherwise. The use of the articles "a," "an" and "the" are meant to be interpreted as referring to the singular as well as the plural, unless the context clearly dictates otherwise. Thus, for example, reference to "a cover portion" includes two or more such cover portions, and the like, unless the context clearly dictates otherwise. The use of "optional" or "optionally" means that the subsequently described element, event or circumstance may or may not be present/occur, and that the description includes instances where the element, event or circumstance occurs and instances where it does not, unless the context clearly dictates otherwise. The use of "exemplary" means "an example of" and is not intended to convey a meaning of an ideal or preferred embodiment, unless the context clearly dictates otherwise.

The figures illustrate a number of different exemplary systems for storing devices with elongated shafts. The "devices with elongated shafts" illustrated in the figures are golf clubs. Other devices with elongated shafts include, but are not limited to, fishing poles.

FIGS. 1 through 9, illustrate the first exemplary system 10 for storing devices 2 with elongated shafts 4. FIGS. 10 through 13, and 18 though 22, illustrate the second exemplary system 100 for storing devices 2 with elongated shafts 4. FIGS. 14 through 17 illustrate the third exemplary system 200 for storing devices 2 with elongated shafts 4. FIG. 18 illustrates the fourth exemplary system 300 for storing devices 2 with elongated shafts 4. The exemplary illustrated systems are similar to one another, except as detailed below. In this description, and in the drawings, similar structures are labeled with identical numbers for simplicity. These systems (10, 100, 200, 300), for simplicity, referred to collectively as the "system," unless the context clearly dictates otherwise.

The device 2 having an elongated shaft 4, a shank portion 6, and an end portion 8. The end portion 8 may include a grip portion 7.

The system comprising a body portion 20 and at least one cover portion 50. The body portion 20 illustrated in these Figures is generally cylindrical in shape. Such a generally cylindrical shape is preferred, but other shapes would likewise be suitable, including oval, triangular and polygonal. The body portion 20 comprising a closed bottom portion 22 connected to an open top portion 30 via a sidewall portion 40. In the exemplary system 10 illustrated in FIG. 1, the body portion is rigid. The space between the closed bottom portion 22 and the open top portion 30 defining an interior chamber.

An opening 42 is defined through the sidewall portion 40. In the exemplary system shown, the opening 42 extends from the open top portion 30 towards the closed bottom portion 22. The figures showing an open-topped opening 42 having a pair of generally vertical sides (first side 41 opposite second side 43) and a generally horizontal bottom side 45. Other configurations and shapes of openings could be used. The opening 42 illustrated in FIG. 1, extending from the top portion downwards generally 80% to 90% of the height of the body portion, and would be 3.0 to 6.0 inches (7.62 cm to 15.24 cm) in width. While these measurements specifically mentioned here, a person having ordinary skill in the art would adjust all such measurements as necessary in making a particular system for use for a particular purpose.

When the system is a golf club bag, a user is able to retrieve and return their golf clubs via the front of the golf club bag (through the opening 42) instead of the top of the golf club bag. This allows the golfer much easier access to their clubs during a round of golf or during practice. In addition, the system affords golfers that have a difficult time putting clubs into the top of a standard bag due to physical limitations or height or injury or limited range of motion a much easier alternative.

The sidewall portion 40 comprises an interior sidewall surface 44 and an external surface 46. In the system 10 illustrated in FIGS. 1 through 4, the sidewall portion 40 is generally circular in shape vertically below the opening bottom side 45, and generally arc-shaped vertically along the opening's 42 vertical height (between the first side 41 and second side 43), where the body portion is generally arc-shaped. The interior sidewall surface 44 could comprise indicia (e.g., logo, artwork). The bottom side 45 (or the bottom portion 22) could comprise a track, ledge or other surface protruding in a perpendicular fashion for supporting the cover portion 50.

The cover portion 50 is for covering (closing) the opening 42. The cover portion 50 illustrated in these Figures having a generally open-ring or "arc" shape, having a cover opening 58. The cover portion 50 having an open position (illustrated in FIG. 1) and a closed position (illustrated in FIG. 8). The cover portion 50 closing at least a portion of the opening 42 when the cover portion 50 is in its closed position. The cover portion 50 spaced apart from the opening 42 (not closing) when the cover portion 50 is in its open position.

In the system 100 illustrated in FIGS. 10 through 13 and 18 through 22, the cover portion(s) (50, 52, 54) each comprising an outside surface (55, 155, 255). The outside surface(s) can be configured for connection with an accessory. For instance, FIGS. 10, and 19 through 21 illustrate a container 56 attaching to the outside surface 255, a panel 57 attaching to the outside surface 155, and a container 156 attaching to the outside surface 55. The containers 56, 156 could be rigid sided, cloth bags, or other suitable structure. The panel 57 could be decorative, for instance including a logo (e.g., the user's favorite sports team logo). The cover portions can be fixedly or removably attached to the outside surface(s). In one example exemplary system, the connection comprises the use of a hook-and-loop style releasable connector, allowing the user of the system to add/remove accessories as desired. The accessories (e.g., container 56, panel 57, container 156) may have a semi-rigid form or backing on them that would match the circular nature of the rotator to which they will be installed or adhered to. This backing or form to the pockets allows the pockets to retain their original shape and full volume and eases attachment to the desired position on the cover portion.

Figure 8:
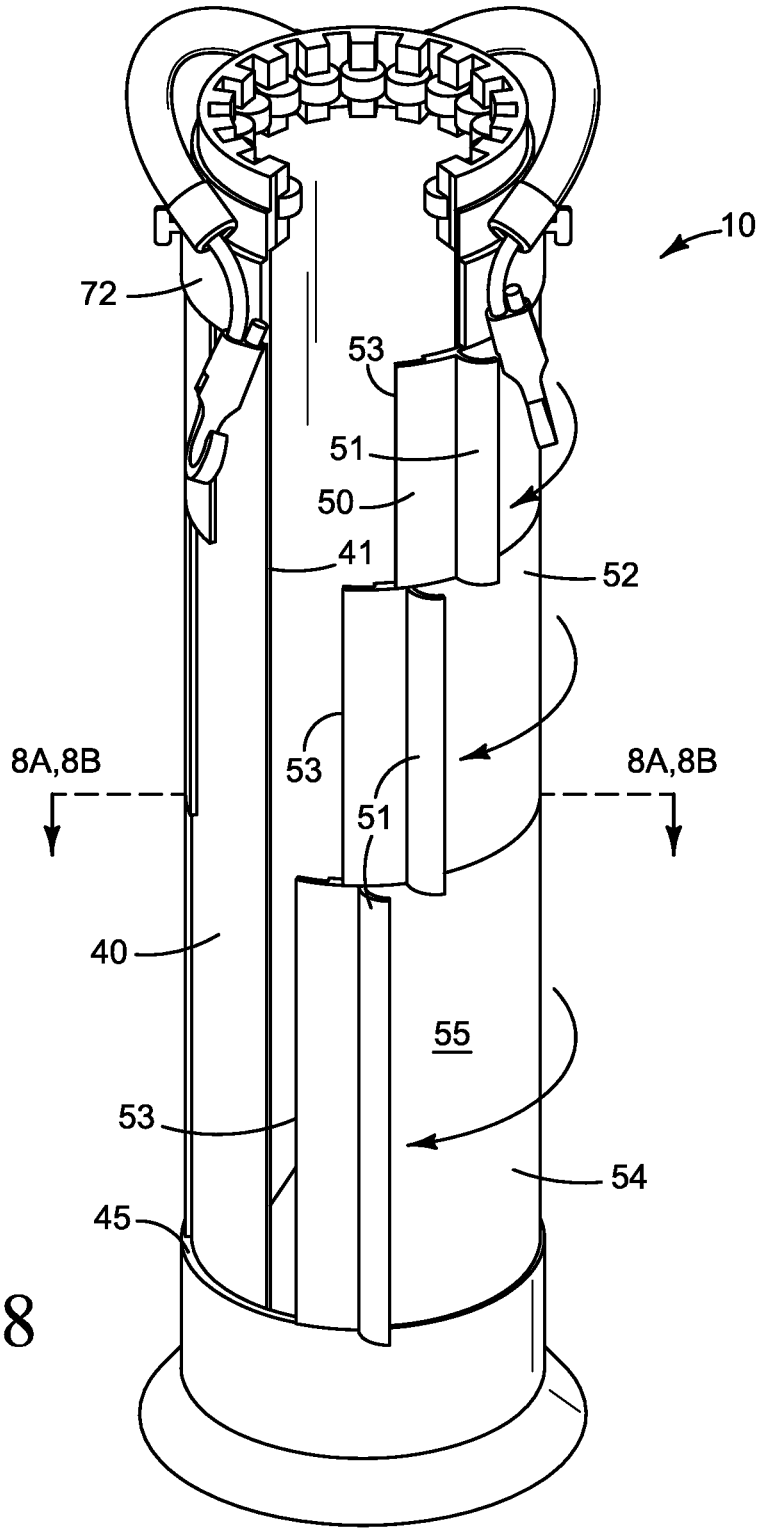
FIG. 8 is a seventh perspective view of the first exemplary system of FIG. 1.
Figure 8A:
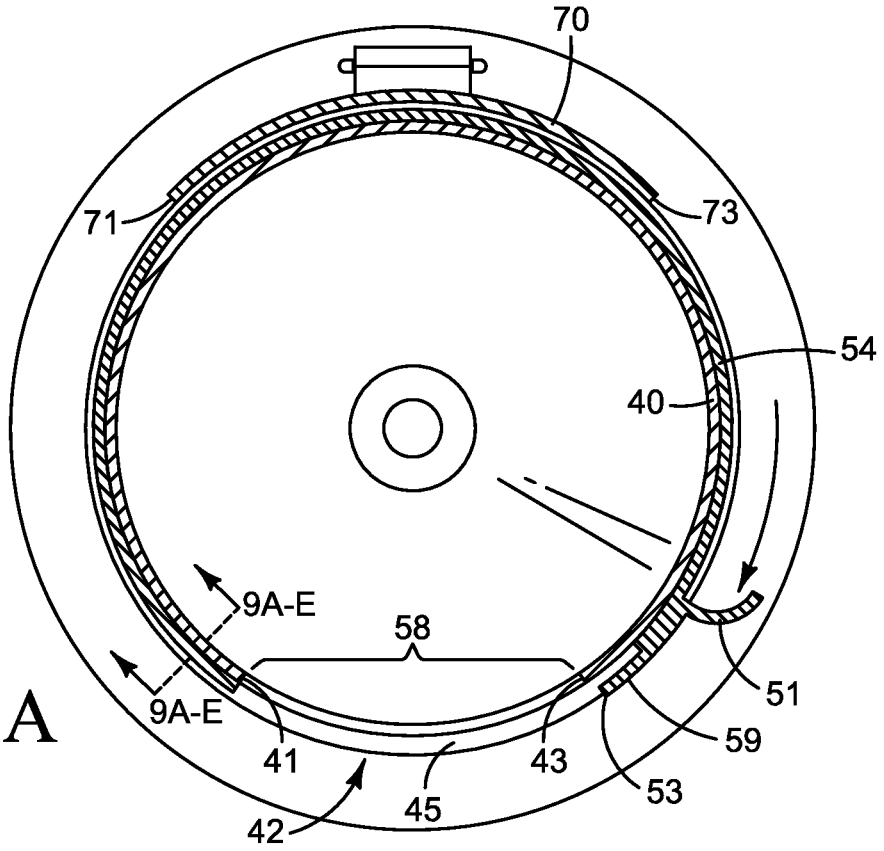
FIG. 8A is a sectional view of the view illustrated in FIG. 8 along line 8A-8A.

In an exemplary system, the width of the cover opening 58 generally corresponds with the width of the opening 42. In such a configuration, when the cover portion 50 is in its "open" position, none of the cover portion 50 covers the opening 42, as illustrated in FIG. 8A.

In the system illustrated in FIGS. 1 through 4, the open-ring shaped cover portion has a first diameter, whereas the generally cylindrically-shaped body portion 20 has a second diameter. As can be seen from these Figures, the first diameter is larger than the second diameter, so that the cover portion 50 can fit around the body portion 20, being located external to the body portion 20. In other exemplary systems (not illustrated), the body portion 20 may have a larger diameter than the cover portion, so that the cover portion 50 can be located internal to the body portion.

The cover portion 50 illustrated in FIGS. 1 through 4 does not vertically cover the entire opening 42. A second cover portion 52 and a third cover portion 54 are provided for working with the cover portion 50 to cover the opening 42. Each of the plurality of cover portion (50, 52, 54) close at least a portion of the opening 42 when in the closed position. While these Figures illustrate the use of three cover portions, other embodiments may have one, two, or more cover portions.

Figure 23:
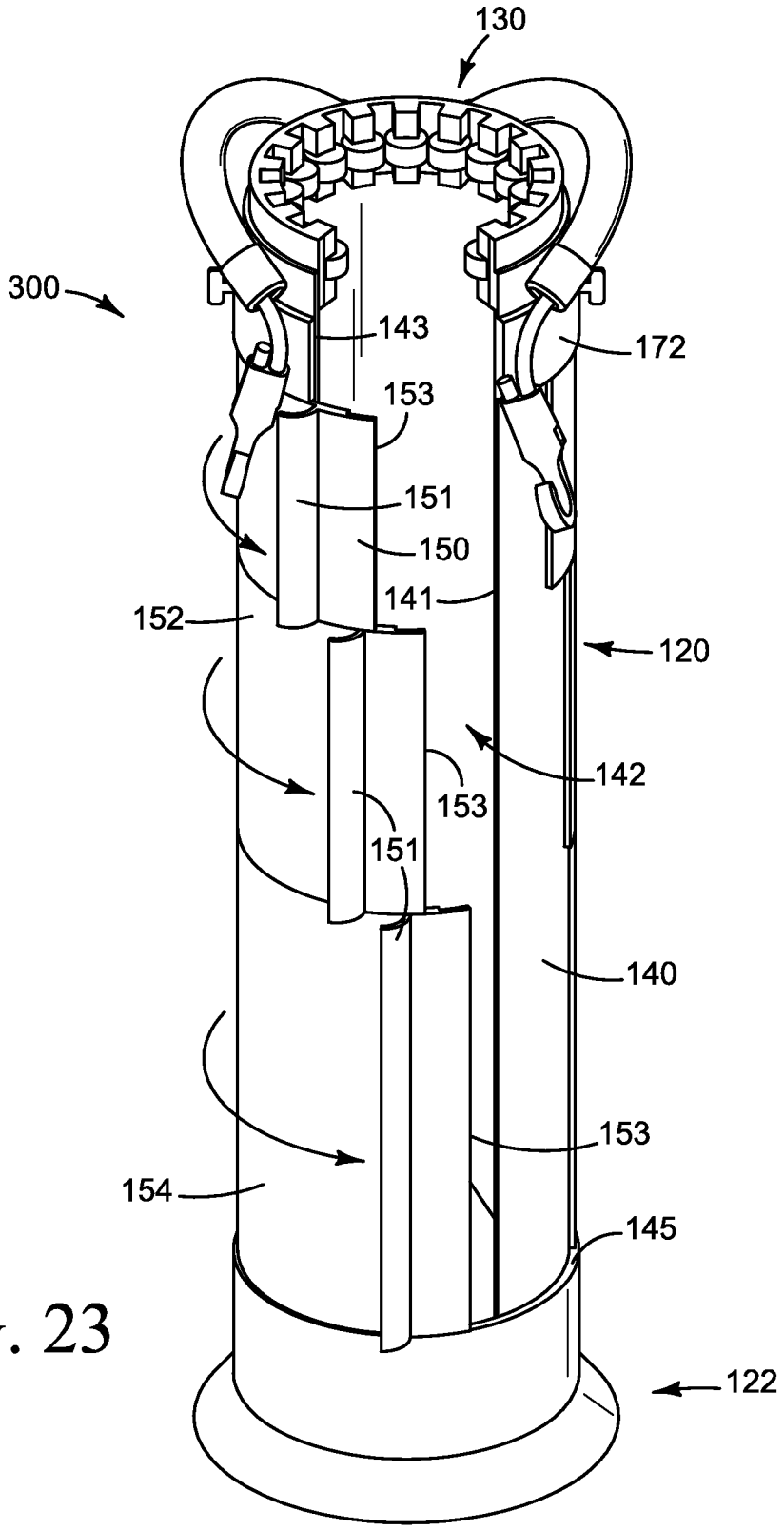
FIG. 23 is a first perspective view of a fourth exemplary system for storing devices with elongated shafts.

In such a configuration, the rotatable cover portion(s) enable the system to convert from an open position where the contents are accessible to a closed position where contents are protected from weather, damage from outside forces, and unauthorized access. FIG. 23 (described infra) illustrates the cover portions "flipped" 180 degrees.

The cover portion 54 illustrated in FIGS. 1 through 6 comprising a handle 51. The handle 51 for enabling a user to move the cover portion 54 from its closed position to the open position. Other types and forms of handles could be utilized. Such a handle 51 is optional.

Further optionally, the first end 53 of the cover portion 50 may comprise an overlap portion 59 which is configured for allowing the cover portion 50 to overlap the first side 41 of the sidewall portion 40 to form a gap-free connection when in the closed position.

In another exemplary system (not illustrated), the system includes a locking mechanism for locking the cover portion (s) in a desired position. For instance, the cover portion(s) could be locked in the "closed" position where the opening is covered.

Figure 9A:
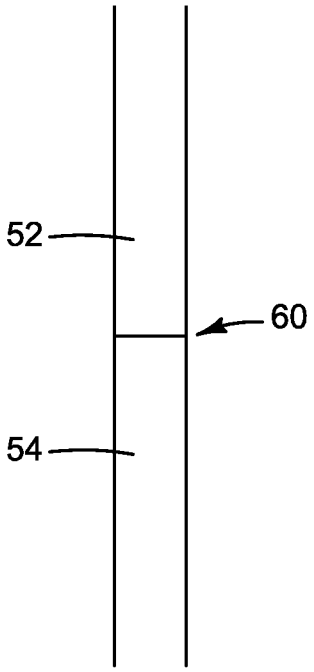
FIG. 9A is a partial, sectional view of the view illustrated in FIG. 8A along the line 9A-A.
Figure 9B:
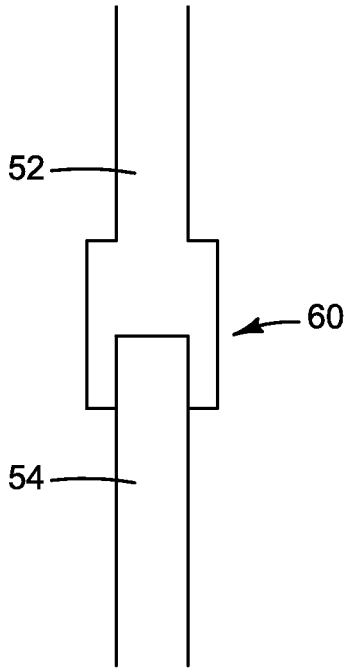
FIG. 9B is a partial, sectional view of the view illustrated in FIG. 8A along the line 9B-B.
Figure 9C:
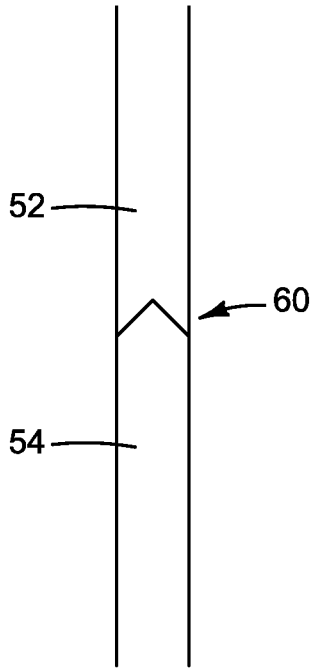
FIG. 9C is a partial, sectional view of the view illustrated in FIG. 8A along the line 9C-C.
Figure 9D:
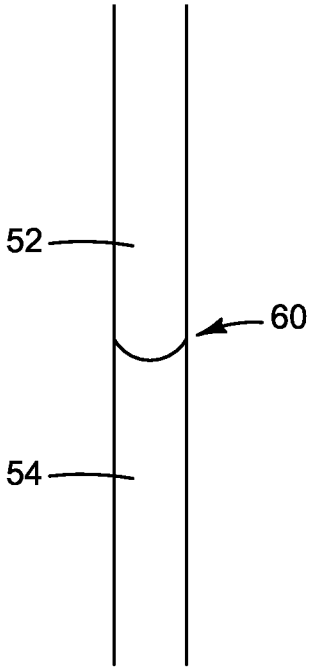
FIG. 9D is a partial, sectional view of the view illustrated in FIG. 8A along the line 9D-D.
Figure 9E:
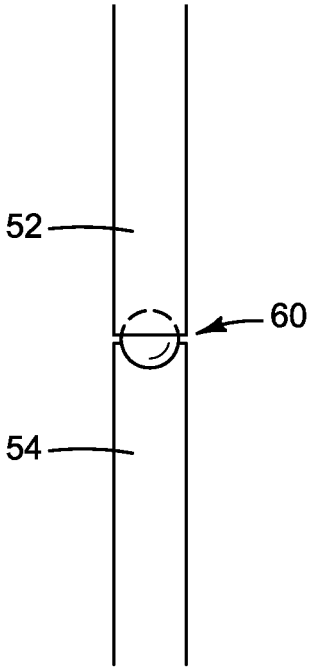
FIG. 9E is a partial, sectional view of the view illustrated in FIG. 8A along the line 9E-E.
Figure 10:
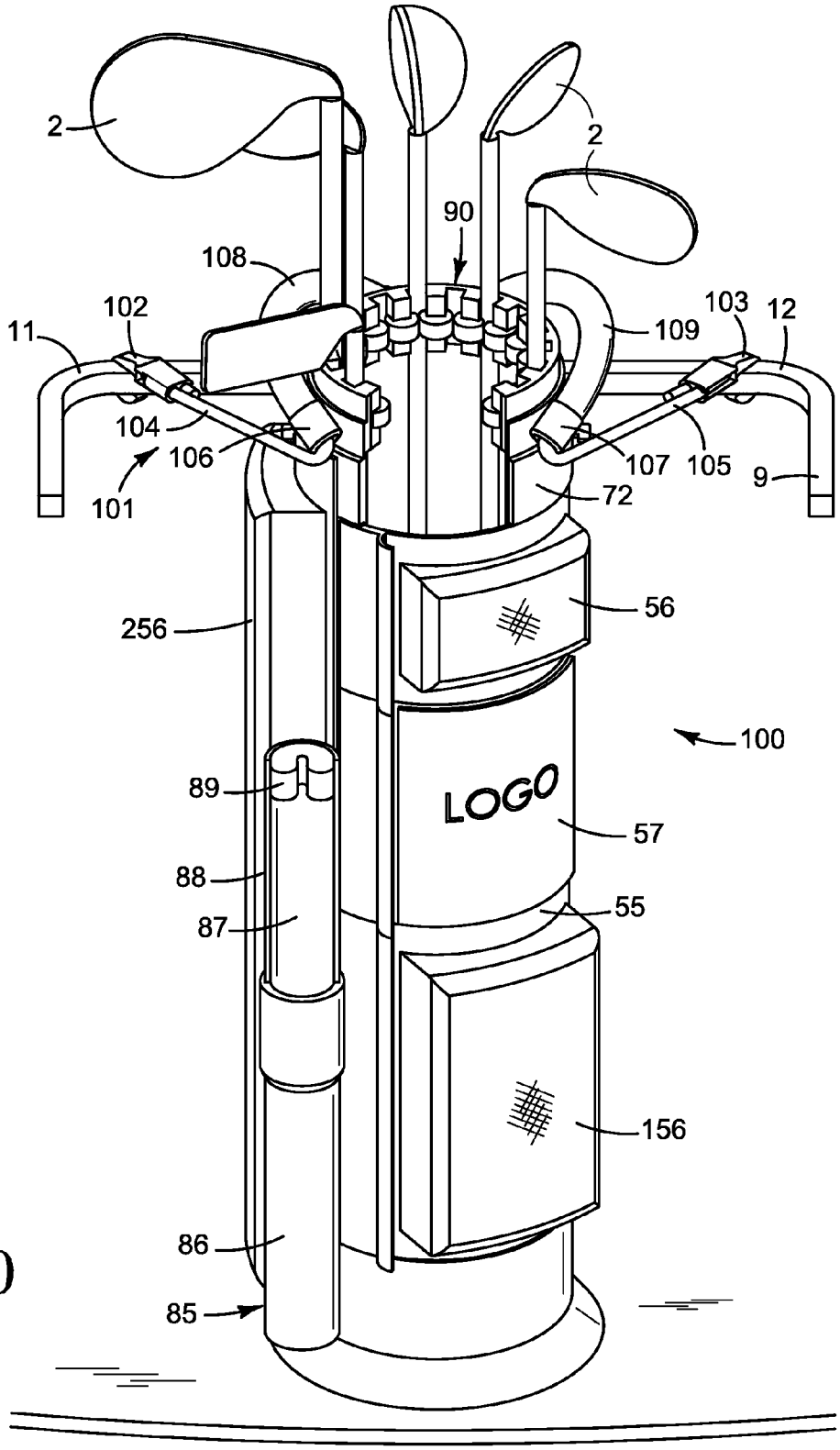
FIG. 10 is a perspective view of a second exemplary system for storing devices with elongated shafts, showing a connection with a vehicle, including a plurality of golf clubs stored therein.
Figure 11:
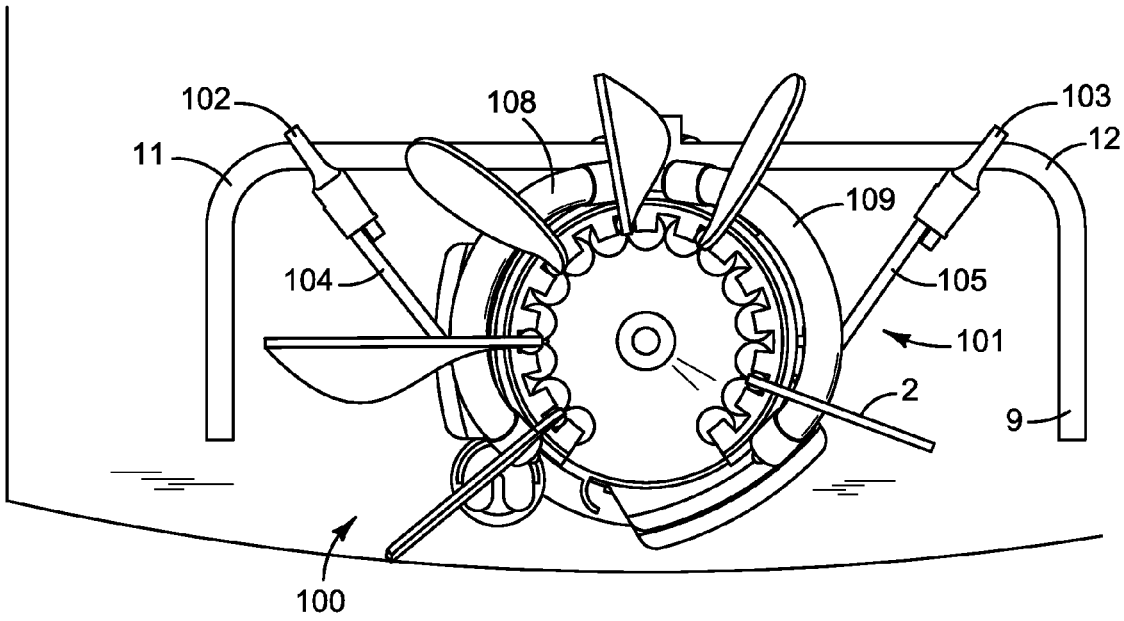
FIG. 11 is a plan view of the second exemplary system of FIG. 10, including a plurality of golf clubs stored therein.
Figure 12:
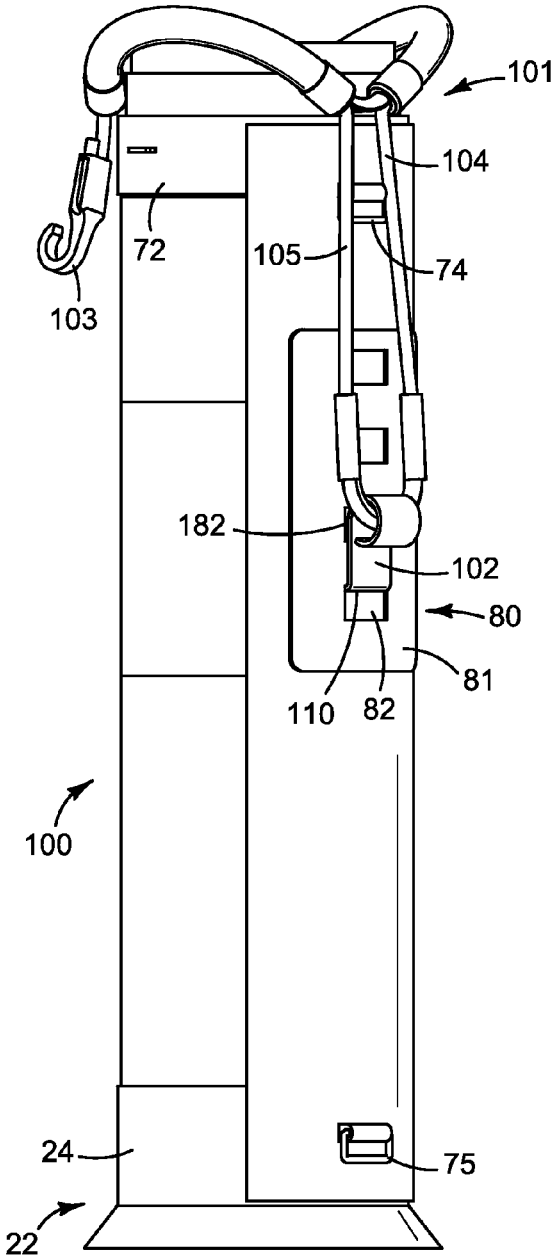
FIG. 12 is a first side view of the second exemplary system of FIG. 10.

In the system illustrated in FIGS. 1 through 4, adjacent cover portions (50 to 52, 52 to 54) slidably connect with each other via one or more cover connector portions. The cover connector portions 60 for connecting the cover portion 50 to the body portion 20. Referring to FIGS. 9A through 9E, illustrated are five different cover connector portions. FIG. 9A illustrating a butt joint. FIG. 9B illustrating a tongue-and-groove style cover connector portion. FIG. 9C illustrating the lower cover connector portion having a point received in a channel defined in the upper cover connector portion. FIG. 9D illustrating the lower cover connector portion having a recess into which a tab defined in the upper cover connector portion is received. FIG. 9E illustrating the upper cover connector portion comprising a ball bearing assembly received into a channel defined in the lower cover connector portion.

Figure 4:
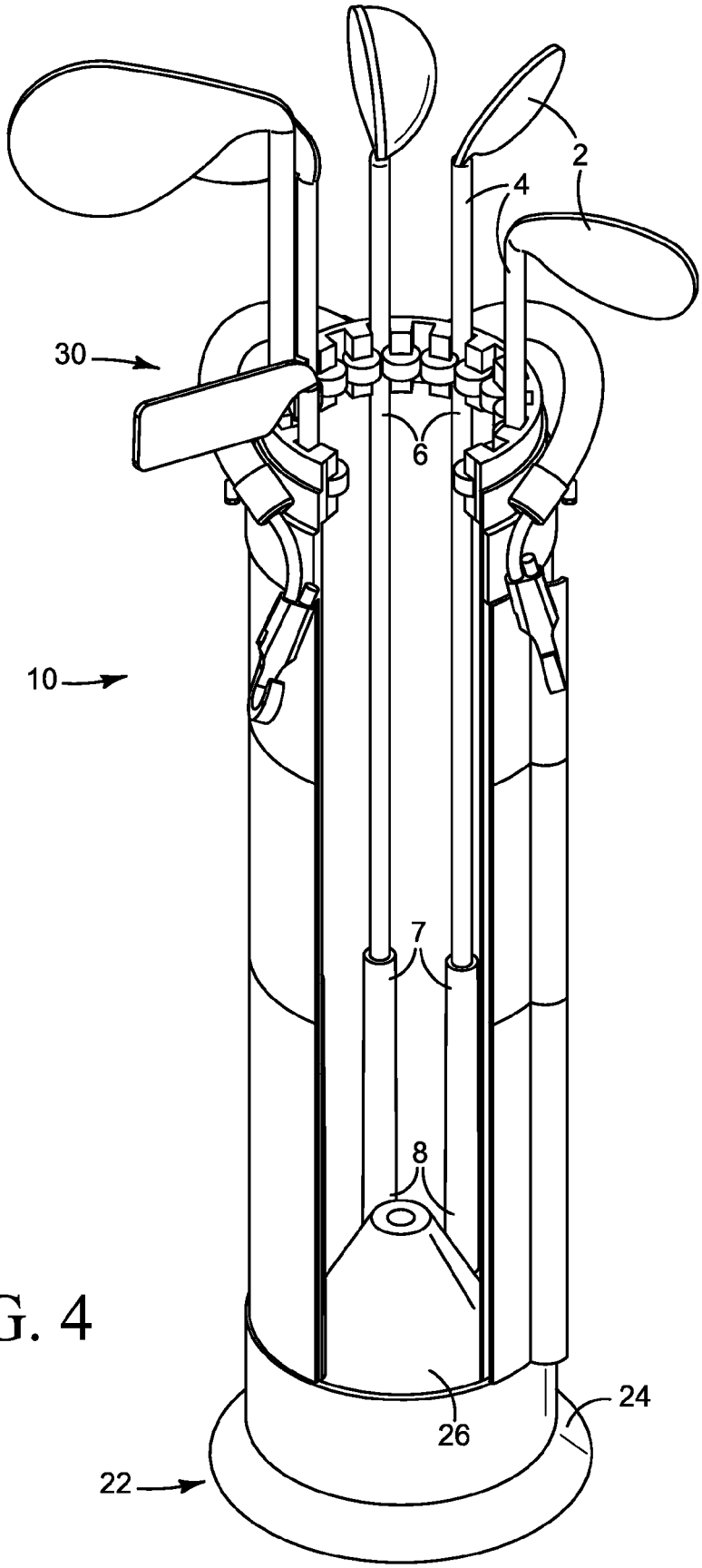
FIG. 4 is a fourth perspective view of the first exemplary system of FIG. 1, including a plurality of golf clubs stored therein.
Figure 5:
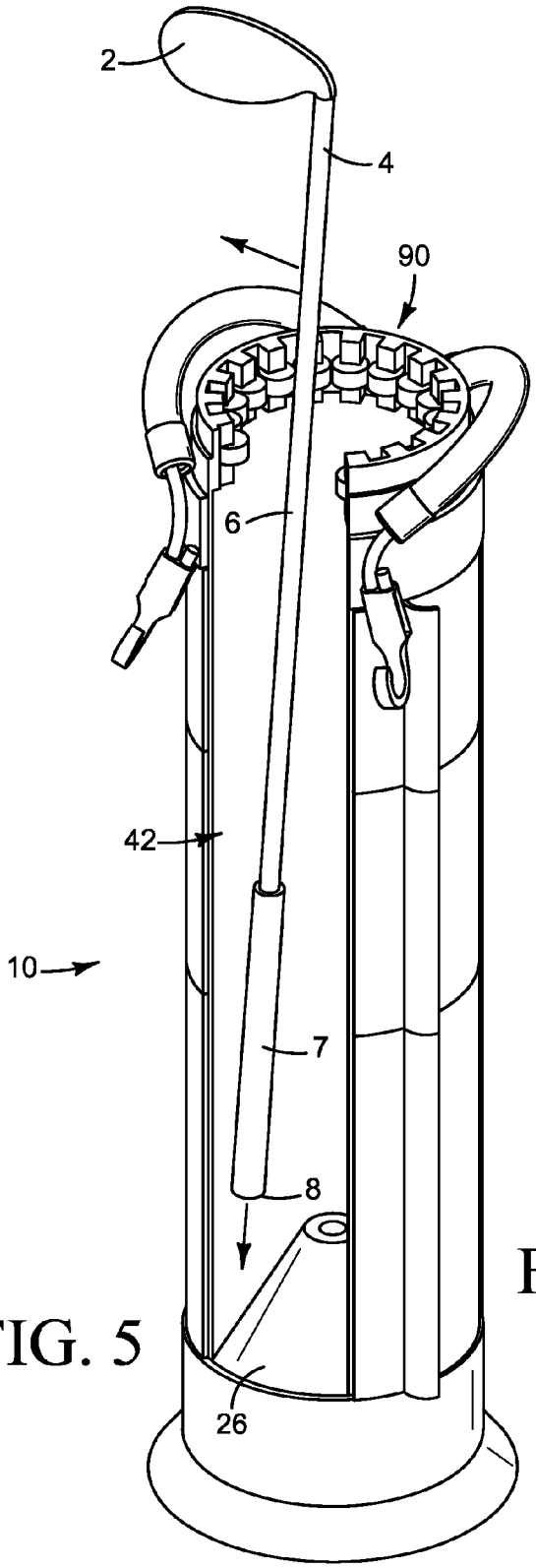
FIG. 5 is a fifth perspective (partial) view of the first exemplary system of FIG. 1, showing the insertion of a golf club therein.

Optionally, the cover portion(s) (50, 52, 54) can connect with the body portion 20 via a body connector portion 25. For instance, as illustrated in FIG. 1, the cover portion 54 connects with the base means 24 at a body connector portion 25. The body connector portion 25 comprising the connection between the upper portion (for instance, the bottom side 45) of the base means 24 and the lower portion of the cover portion 54. As illustrated in FIGS. 1 and 4, the cover portion 54 able to slide along the bottom side 45. In other embodiments, the body connector portion 25 could comprise other suitable structures, for instance, bearings, tongue and groove connections, etc. The illustrated cover portion(s) (50, 52, 54) each comprising an outside surface (55, 155, 255).

The illustrated shroud cover 62 sized to generally extend between the first side edge 71 of the support element 70 to the first side 41 of the opening 42, with the first side edge 65 generally abutting the first side edge 71. Such an abutment may have an overlap, connection, ball socket system, or other orientation serving to mate the shroud cover 62 with the support element 70. Optionally, the shroud cover 62 could be positioned on the opposite side of the opening.

The shroud cover 62 spaced apart from the external surface 46 of the body portion 20 so as to allow the cover portion(s) 50 to pass there-between. The shroud cover 62 connecting at the base means 24 via a hook-and-loop style connector 63 and at the retention ring 72 via a mechanical connector 64 (164). Other types and styles of connectors/connections are possible. The shroud cover 62 providing additional attachment space for one or more additional accessories, for instance container 256.

Figure 19:
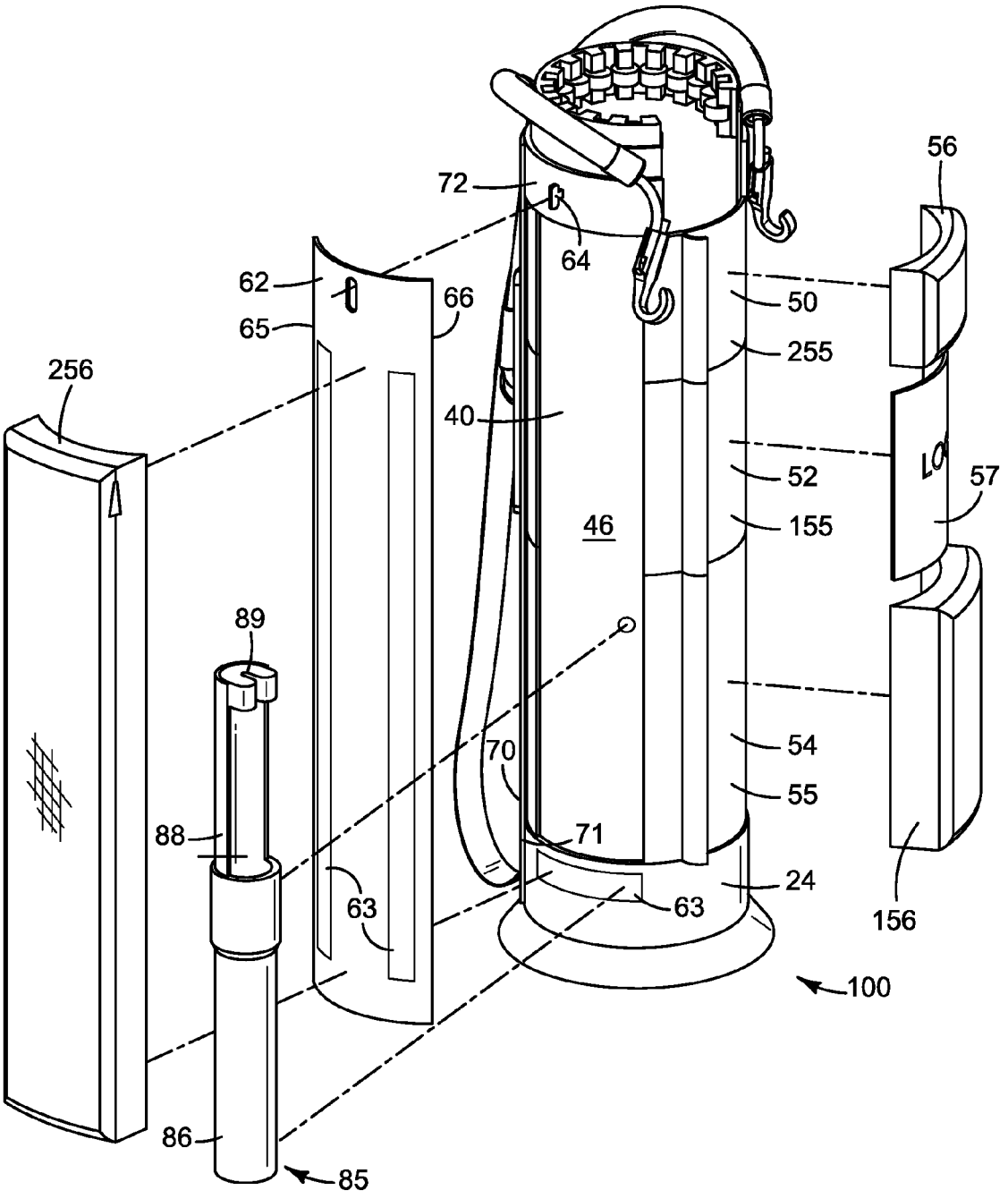
FIG. 19 is an exploded, first perspective view of the second exemplary system of FIG. 10.
Figure 20:
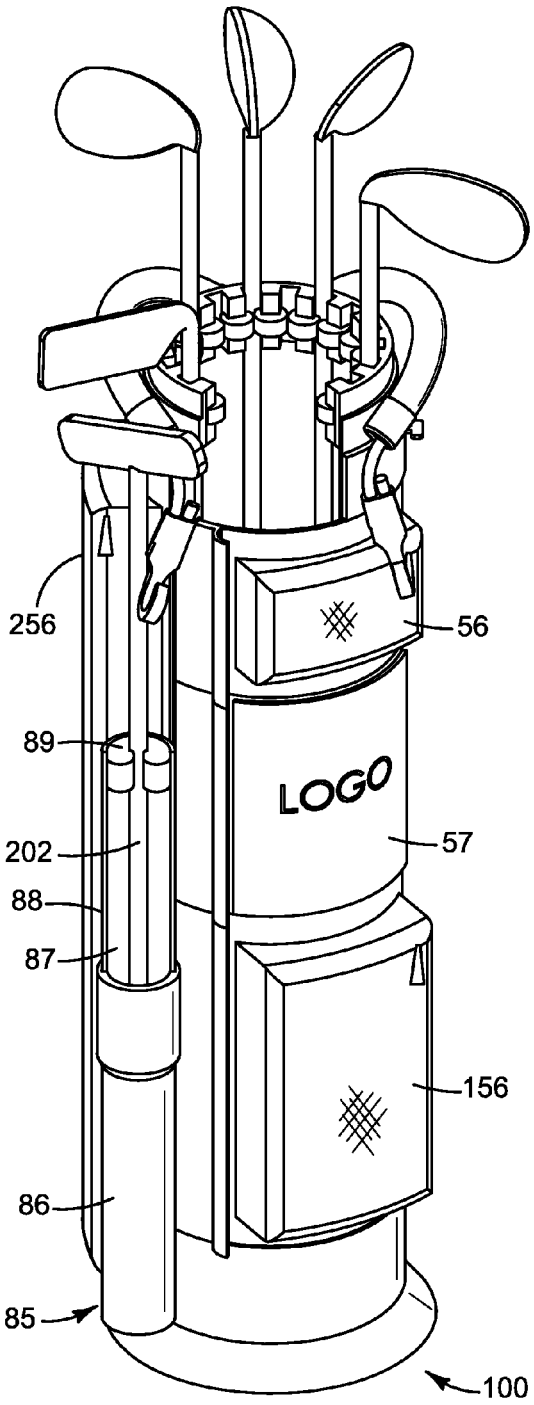
FIG. 20 is a second perspective view of the second exemplary system of FIG. 10, including a plurality of golf clubs stored therein.
Figure 21:
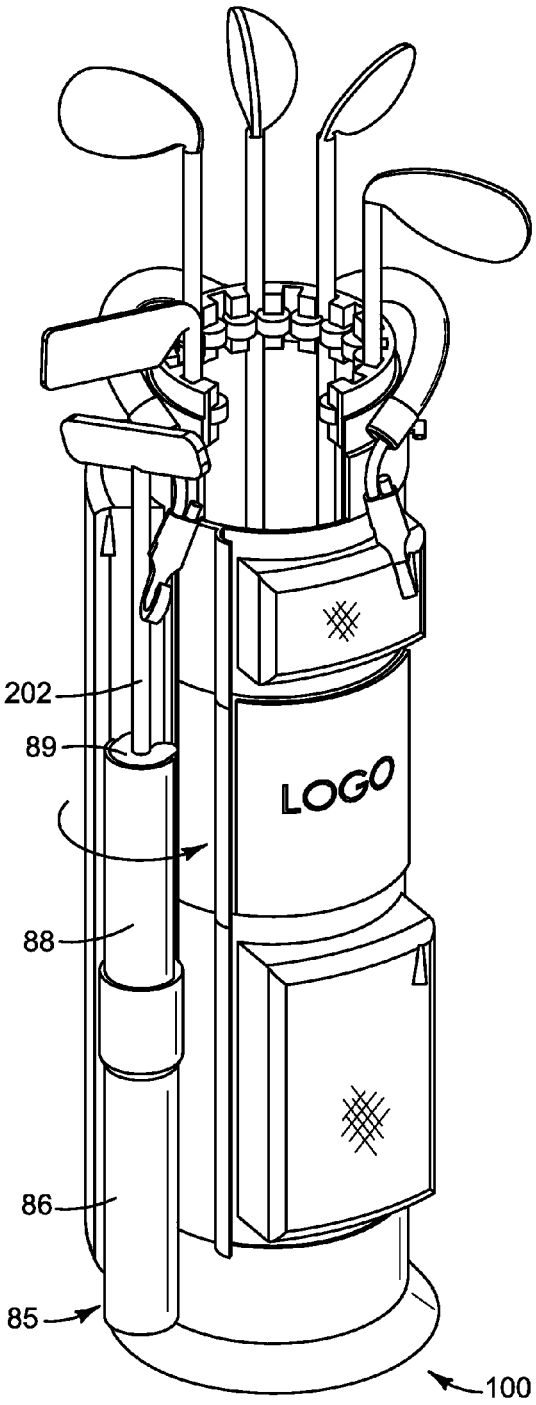
FIG. 21 is a third perspective view of the second exemplary system of FIG. 10, including a plurality of golf clubs stored therein.

FIG. 19 further illustrating a shroud cover 62 configured for attaching to the body portion 20. The shroud cover 62 having a first side edge 65 and a second side edge 66. While the illustrated shroud cover 62 has an arc-shaped cross-section, other shapes are possible.

In such a configuration, a locking means (not illustrated) could be provided for locking the cover portion(s) 50 to the shroud cover 62. Examples of exemplary locking means include mechanisms that serve to lock the slider into place when it is inserted in the slot (e.g., magnets, spring retention apparatuses, hook-and-loop fabric, mechanical locking mechanisms).

Alternatively, a separate connector portion could be provided, or one that extends from the sidewall, or the back connector, etc. For instance, the connector portion could comprise at least one track attached to (or extending from) the body portion that the cover portion travels around.

The bottom portion 22 comprises a base means 24, a center spacer portion 26 and a center spacer portion surface 27.

The center spacer portion 26 and the center spacer portion surface 27 forming a vertical alignment apparatus for assisting the vertical alignment of devices stored in the system. The center spacer portion 26, in the exemplary system illustrated in FIGS. 1 through 4, rests upon, upwardly extends from, or is otherwise connected to the center spacer portion surface 27. The center spacer portion surface 27 spaced apart from the interior sidewall surface 44, thereby defining a retention channel 28 there-between.

In use, the end portion 8 of the device 2 can be inserted into the body portion 20 through the open top portion 30 or through the opening 42. The end portion 8 can then be advanced into the retention channel 28, where the end portion 8 is pressed into contact with both the interior sidewall surface 44 and the center spacer portion surface 27 of the center spacer portion 26. The end portion 8 releasably held in place by a friction fit between the interior sidewall surface 44 and the center spacer portion surface 27. In such a configuration, the center spacer portion 26 has an acute angle relative to the interior sidewall surface 44.

By utilizing such a friction fit, coupled with the utilization of the horizontal shaft spacer portion 90 to hold the other end of the shaft, the device 2 is protected from damage due to contacting other devices stored in the system at the same time, particularly when the system is transported over uneven terrain. An additional benefit is the noise reduction inherent in preventing devices from banging against one another during transport.

The center spacer portion 26 serves to automatically force the end portions 8 of the shafts 4 toward the interior sidewall surface 44. Such a configuration allows end portions 8 of differing sizes (e.g., diameters) to be accommodated for, wherein a shaft having a larger diameter end portion 8 would be stored higher in the retention channel 28, while shafts having a smaller diameter end portion would be stored lower in the retention channel 28. If such shafts had similar lengths, the result would be that the shafts having a larger diameter end portion 8 would extend further out of the open top portion 30 than shafts having a smaller diameter end portion 8.

The shape of the center spacer portion 26 can vary based upon the application (e.g., to accommodate different end portion sizes, to accommodate different length shafts, to have some shafts positioned higher than others). As illustrated in the exemplary system 10 (FIGS. 1, 2, 4, 5, 6, 7, 7A, 7B, 7C, 8, 8A, and 8B), in the exemplary system 100 (FIGS. 11 and 22), and in the exemplary system 200 (FIGS. 14, 15 and 17) and 22, the center spacer portion 26 can comprise a generally frustoconical shape. The center spacer portion could have other shapes, including but not limited to generally curved, generally conical, generally frustoconical, and pyramidal.

Figure 16:
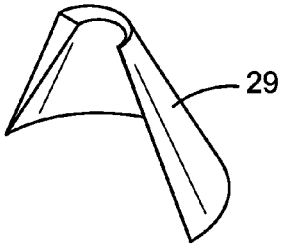
FIG. 16 is a partial, perspective view of a variable pitch conical spacer used with the third exemplary system of FIG. 14.
Figure 17:
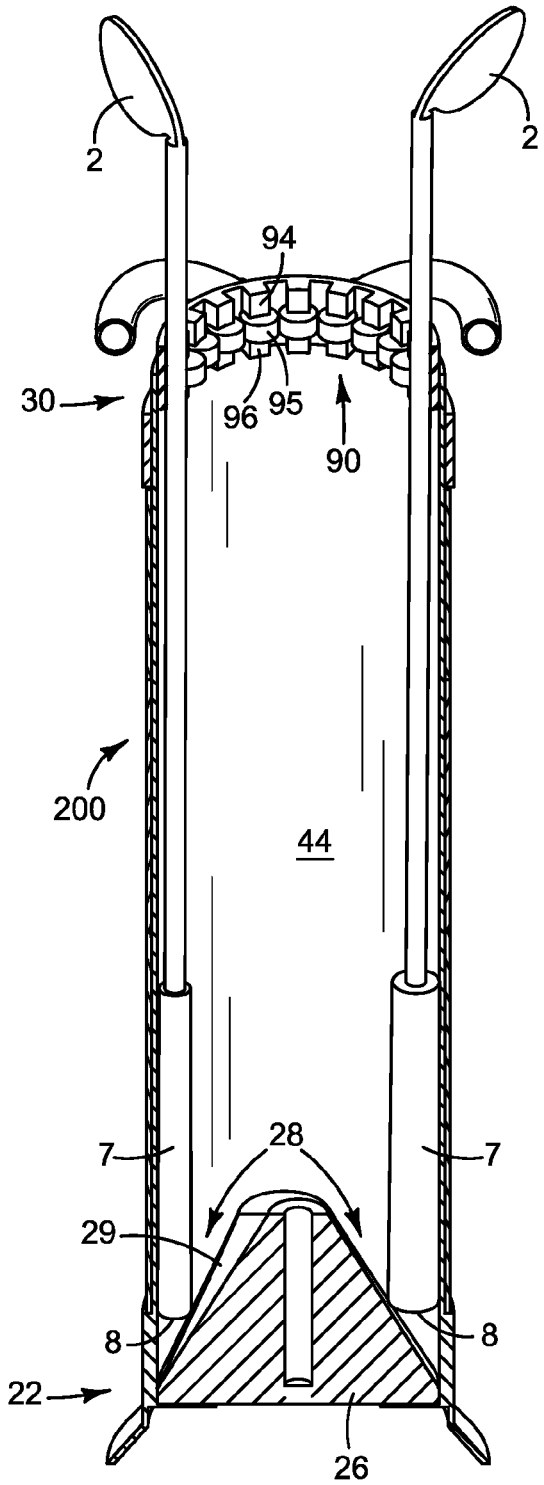
FIG. 17 is a third sectional view of the third exemplary system of FIG. 14, including a plurality of golf clubs stored therein.
Figure 18:
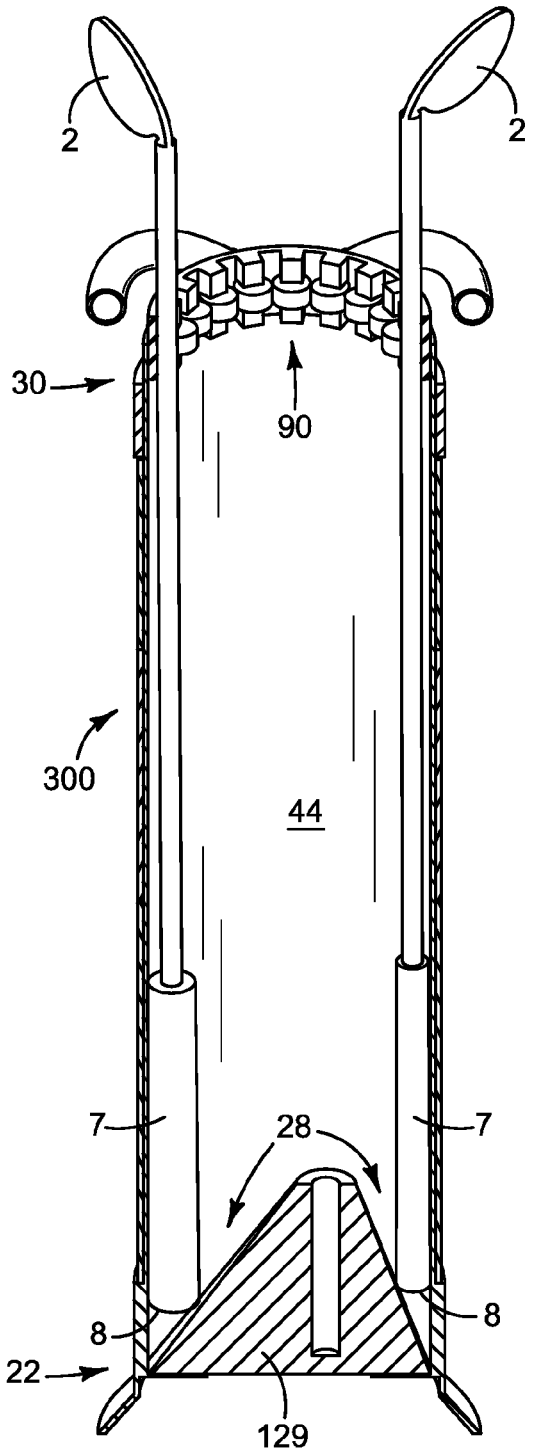
FIG. 18 is a sectional view of a fourth exemplary system, including a plurality of golf clubs stored therein.

FIG. 16 illustrates a variable pitch conical spacer 29 which can be placed upon the center spacer portion 26 (as illustrated in FIG. 17), so as to create a variable pitch for the center spacer portion. FIG. 18 illustrates utilization of a variable pitch spacer 129 instead of the combined center spacer portion 26 and variable pitch conical spacer 29 illustrated in FIG. 17.

In other exemplary systems (not illustrated), instead of utilizing a center spacer portion 26 and interior sidewall surface 44 to form the retention channel, the retention channel can instead comprise structure attached to, or extending from the interior sidewall surface.

Figure 15:
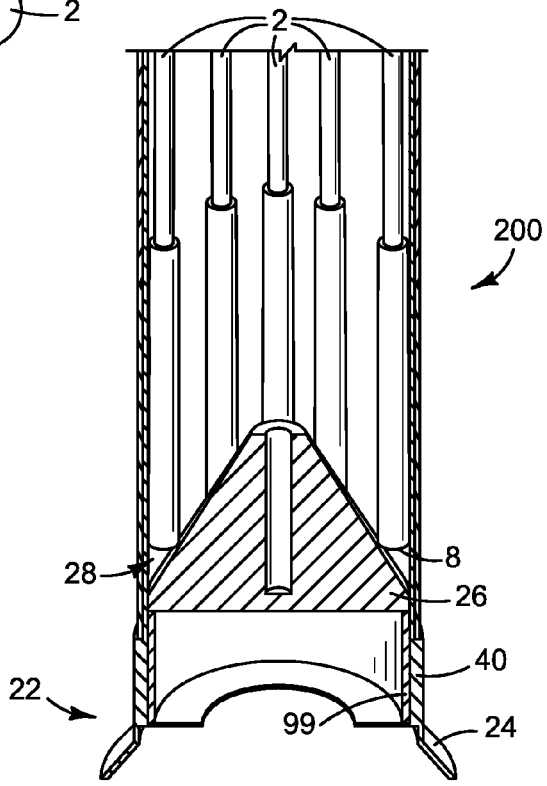
FIG. 15 is a second, partial, sectional view of the third exemplary system of FIG. 14, including a plurality of golf clubs stored therein.

In FIG. 15, a riser 99 is illustrated. The riser 99 serving to elevate vertically the shafts of the devices stored therein, for instance, when a child's golf clubs are utilized instead of adult sized golf clubs. This elevation accomplished by positioning the center spacer portion 26 higher within the interior chamber 23. The use of a riser 99 allowing shorter length devices to be able to reach and connect with both the retention channel 28 and the horizontal shaft spacer portion 90. In a first exemplary riser 99, the riser 99 is solid. In a second exemplary riser, the riser comprises a storage chamber proving additional storage.

In another exemplary system, an interior sidewall surface spacer (not illustrated) is placed inside the interior chamber 23 within or adjacent the retention channel 28 and against or adjacent the interior sidewall surface 44. The spacer serving to narrow the retention channel 28, making the end portion 8 of a device 2 inserted therein contact center spacer portion surface 27 in a higher position, therefore raising the shaft higher, and making the opposite end of the shaft protrude higher from the open top portion 30. The spacer could have a uniform thickness along its length, could have a different thickness, or could taper from one thickness to another. The spacer could be arc shaped, circular, or otherwise shaped. In such a configuration, the spacer allows the center spacer portion 26 to be adjustable for individual clubs or a series of clubs.

Figure 22:
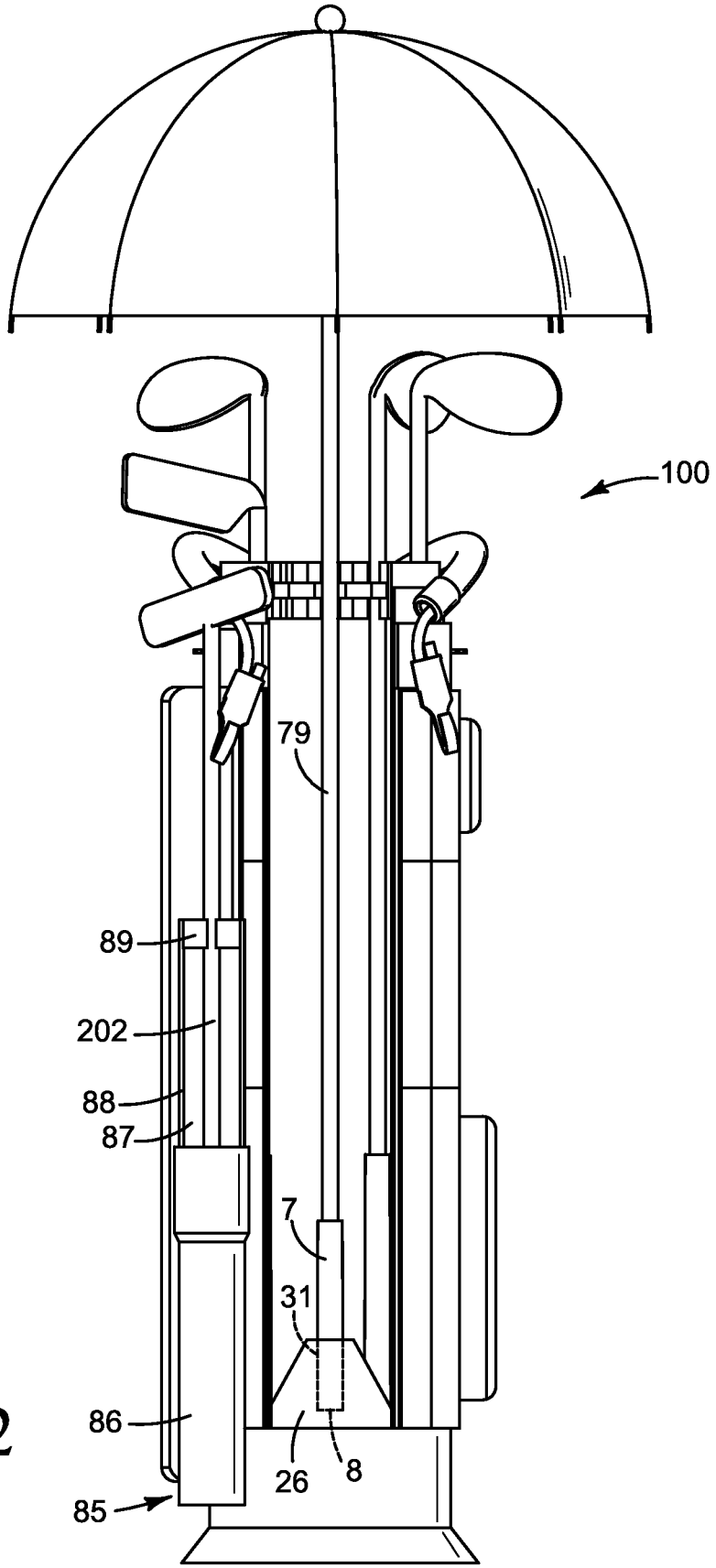
FIG. 22 is a fourth perspective view of the second exemplary system of FIG. 10, including a plurality of golf clubs and an umbrella stored therein.

The center spacer portion 26 can comprise an accessory connector 31, such as a recess defined in the center spacer portion 26 for receiving an accessory such as the extendable umbrella 79 illustrated in FIG. 22. Optionally, the end portion of the umbrella 79 could be inserted into the retention channel 28 with the shaft of the umbrella 79 connected into the horizontal shaft spacer portion 90.

Figure 8B:
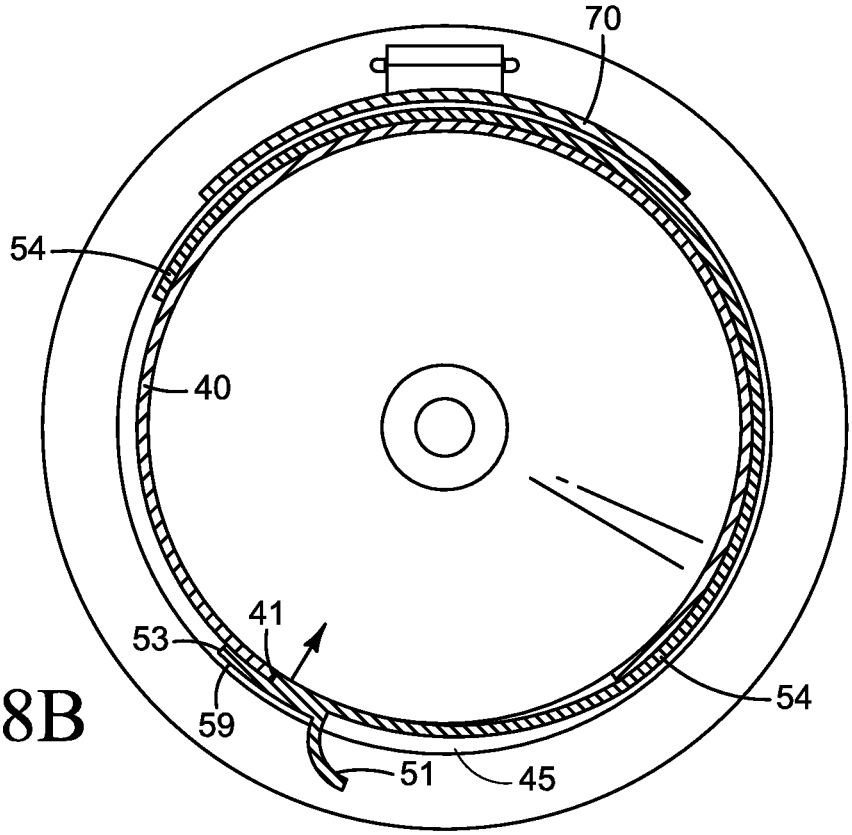
FIG. 8B is a sectional view of the view illustrated in FIG. 8 along the line 8B-8B.

The system further comprises a support element 70 for supporting the body portion 20. The support element 70 illustrated in the Figures connecting to the bottom portion 22 of the body portion 20. The support element 70 having, as illustrated in FIGS. 8A and 8B, a first side edge 71 and a second side edge 73. The support element 70 extending away (upwards) from the bottom portion 22.

In the exemplary system, the support element 70 is generally curved and serves as a guide for the cover portion(s) 50, keeping them adjacent the body portion 20. The support element 70 further comprises an open-ring shaped retention ring 72 for supporting the top portion 30 of the body portion 20. In the exemplary system 10 illustrated in FIG. 1, the retention ring 72 is a stiff internal ring attached to the inside or outside of the body portion 20 which has an opening corresponding to and aligned with the opening 42. It is preferred that retention ring 72 be separated from the body portion 20 by a series of spacers or other spacing mechanism creating a void or space between the retention ring 72 and the body portion 20. This void being the appropriate size to allow the upper edge of the uppermost cover portion to move and rotate within the void.

Figure 6:
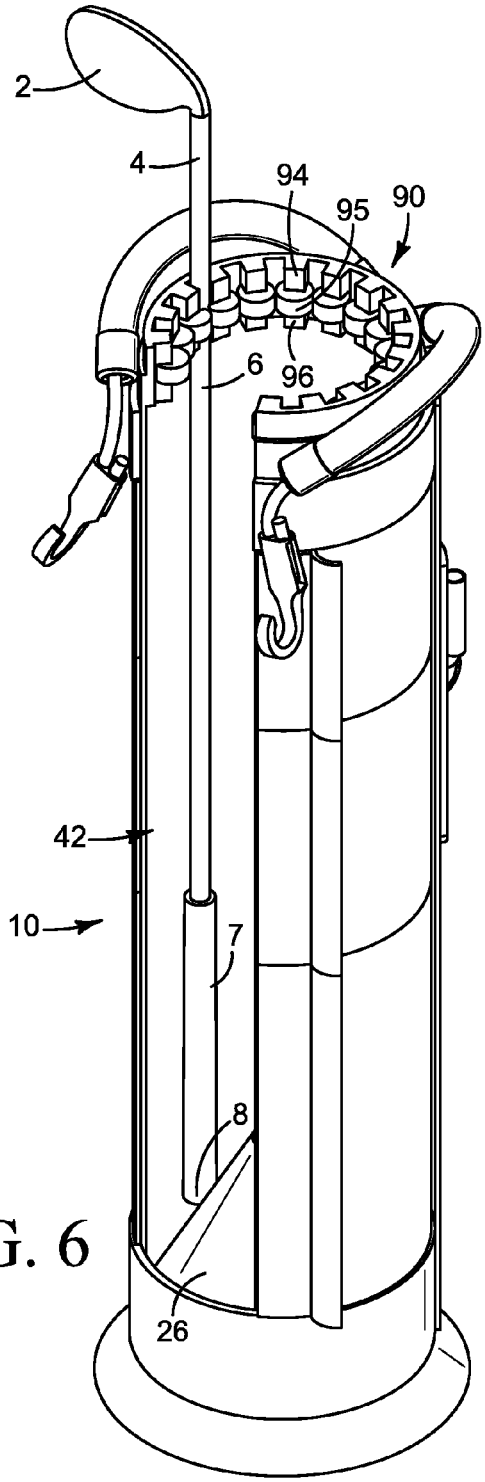
FIG. 6 is a sixth perspective (partial) view of the first exemplary system of FIG. 1, showing the golf club stored therein.

In the exemplary system 10 illustrated in FIGS. 6 and 8A, the support element 70 is located on the opposite side of the body portion 20 as the opening 42. While the system illustrated in the drawings discloses a single retention ring 72, in other exemplary systems, multiple retention rings are present along the opening.

In exemplary systems, the support element 70 may further comprise a back plate 80. The back plate 80 for providing the system with a connection with a connection system 101 (described infra). In the exemplary system 10 illustrated in FIG. 3, and the exemplary system 100 illustrated in FIGS. 12 and 13, the back plate 80 comprises a body 81 mounted on the support element 70. In other exemplary systems, the support element 70 could itself comprise the connection with the connection system 101.

Figure 13:
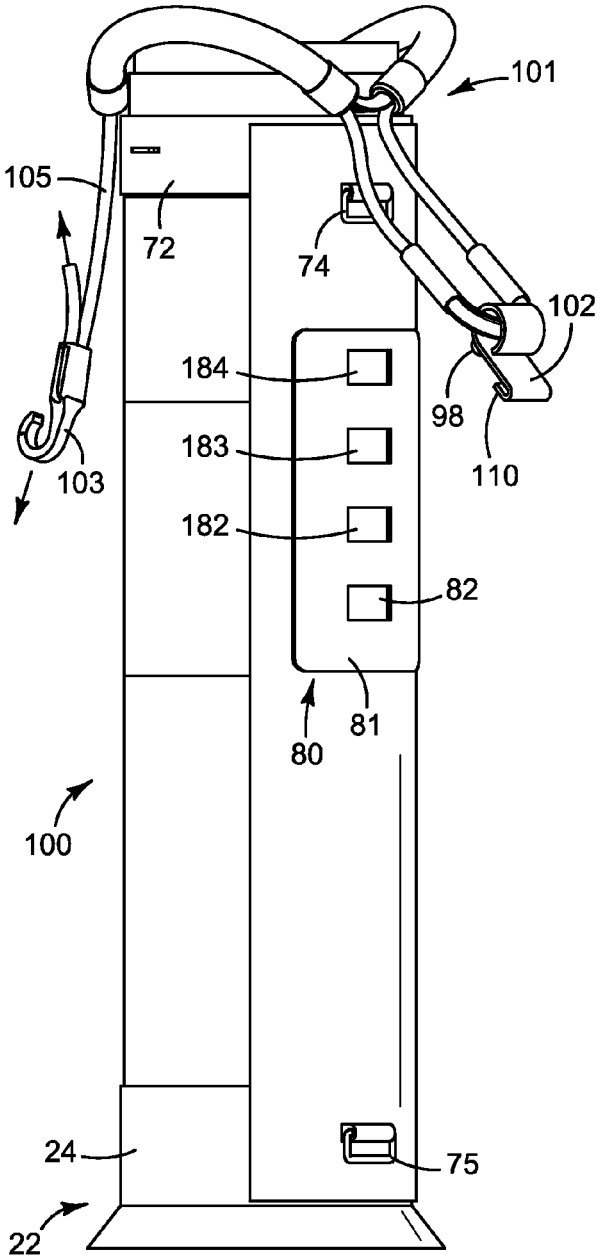
FIG. 13 is a second side view of the second exemplary system of FIG. 10.
Figure 14:
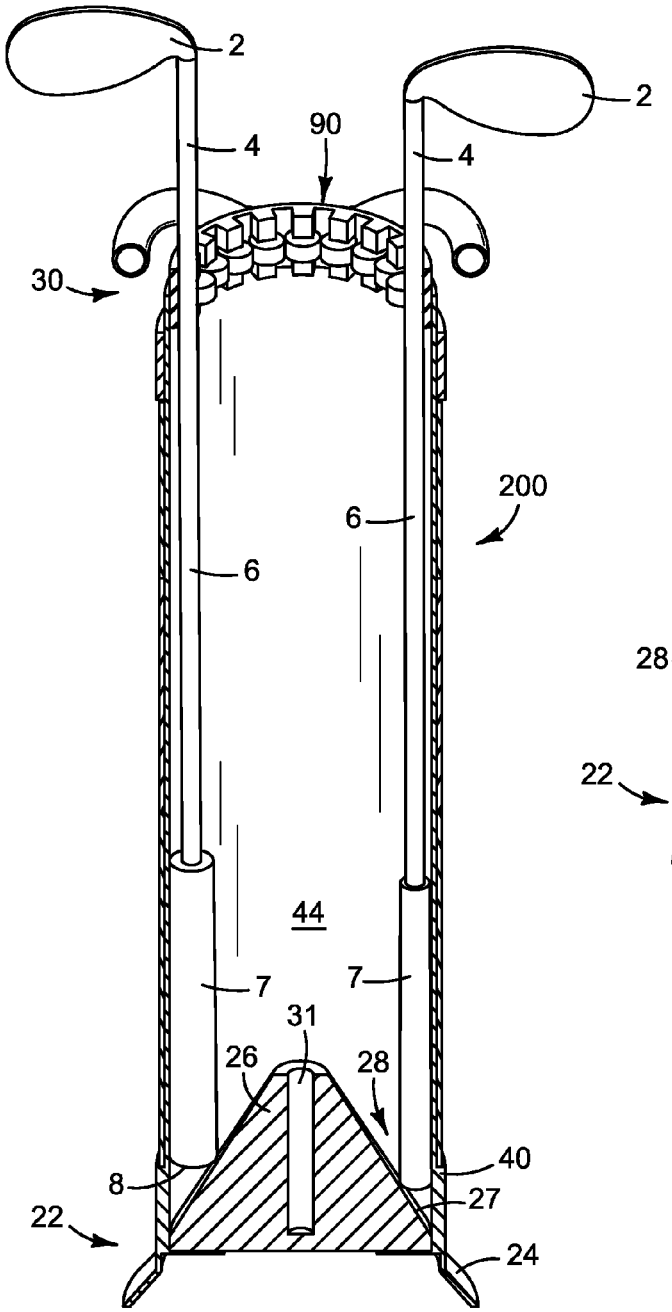
FIG. 14 is a sectional view of a third exemplary system for storing devices with elongated shafts, including a plurality of golf clubs stored therein.

The body 81 comprising at least one strap connector 82 for connecting with the connection system 101. FIG. 13 showing a first strap connector 82, a second strap connector 182, a third strap connector 183, and a fourth strap connector 184. The back plate 80 further serving as a guide for the cover portions. In exemplary systems, the support element 70 comprises a mounting location (e.g., via connectors 74, 75) for support connections, such as a shoulder strap 78.

As illustrated in FIGS. 1, 7, 7A, 7B and 7C, in an exemplary system 10, the body portion 20 may further comprise a horizontal shaft spacer portion 90 adjacent the open top portion 30. The horizontal shaft spacer portion 90 is for receiving and retaining the shank portion of an elongated shaft 4 of a device 2, and spacing it apart from the shank portion of an adjacent elongated shaft. Spacing apart the devices 2 prevents them from contacting one another when the system is moved, thereby decreasing the potential damage and noise caused by the devices impacting one another. The horizontal shaft spacer portion 90 further providing a manner of organizing the devices 2.

As illustrated in the Figures, the horizontal shaft spacer portion 90 is illustrated (in the Figures) as attached to the top inner circumference of the body portion 20, adjacent to the open top portion 30. The exemplary systems (10, 100, 200, 300) illustrating the elongated shafts as the shafts of golf club. As indicated in this disclosure, the elongated shafts could comprise shafts other than golf club shafts.

The horizontal shaft spacer portion 90 is semi-circular in shape matching the tube body and tube body opening. The horizontal shaft spacer portion 90 comprises an inner ring 93. In the illustrated exemplary spacer portion, the inner ring 93 is located on sidewall portion 40. The inner ring 93 serves as a buffer between the device shafts and the body portion 20.

The horizontal shaft spacer portion 90 further comprises a plurality of shaft retainer modules (92, 192) which are spaced apart from one another. While they are "spaced apart," in exemplary spacer portions, adjacent shaft retainer modules may contact one another. The shaft retainer modules (92, 192) connected to the inner ring 93. In exemplary horizontal shaft spacer portions, one or more of the upper retainer, bottom retainer, and/or compressible planar disc may be formed of or connected to the inner ring 93.

The shaft retainer modules 92 (192) comprising an upper retainer 94 (194), a bottom retainer 96 (196), and a compressible planar disc 95 (195) received between the upper retainer 94 (194) and the bottom retainer 96 (196). The upper retainer 94 (194) and the bottom retainer 96 (196) support the compressible planar disc 95 (195) and allow the compressible planar disc 95 (195) to resist upward and/or downward motion if the shaft is moved vertically when held between the shaft retainer modules 92 (192). A recess 97 is defined proximal to the sidewall portion 40, between the adjacent shaft retainer modules (92, 192). The upper retainer 94 (194) and bottom retainer 96 (196) can comprise a single piece defining a recess between for receiving the compressible planar disc 95 (195), or can comprise separate pieces (illustrated in the figures) spaced apart to define the recess.

In the illustrated system, a mechanical fastener (e.g., screw, pin, bolt, rivet) extends through the sidewall portion 40 and/or the inner ring 93 and into the planar disc 95, thereby attaching the planar disc 95 to the sidewall portion 40 and/or the inner ring 93. In such a manner, the planar disc 95 attaches to the inner ring 93 at a single place, thereby enabling the planar disc 95 to slightly move laterally based on its one point connection to the sidewall portion 40 and/or the inner ring 93. This slight side-to-side movement, in cooperation with the compressibility of the planar disc 95, work together to better hold the shaft in place. While the disclosed system shows both compressibility and slight movement, in exemplary systems, one, both or neither may be present.

Alternatively to join the pieces together/adjacent one another, other types of mechanical fasteners could be used, an adhesive could be utilized, sonic welding, the pieces could be molded together, the pieces could be molded separately and joined together, etc. A person having ordinary skill would know how best to join these pieces, and all pieces in the system, together based upon the prospective use, environment, and other considerations.

Figure 7:
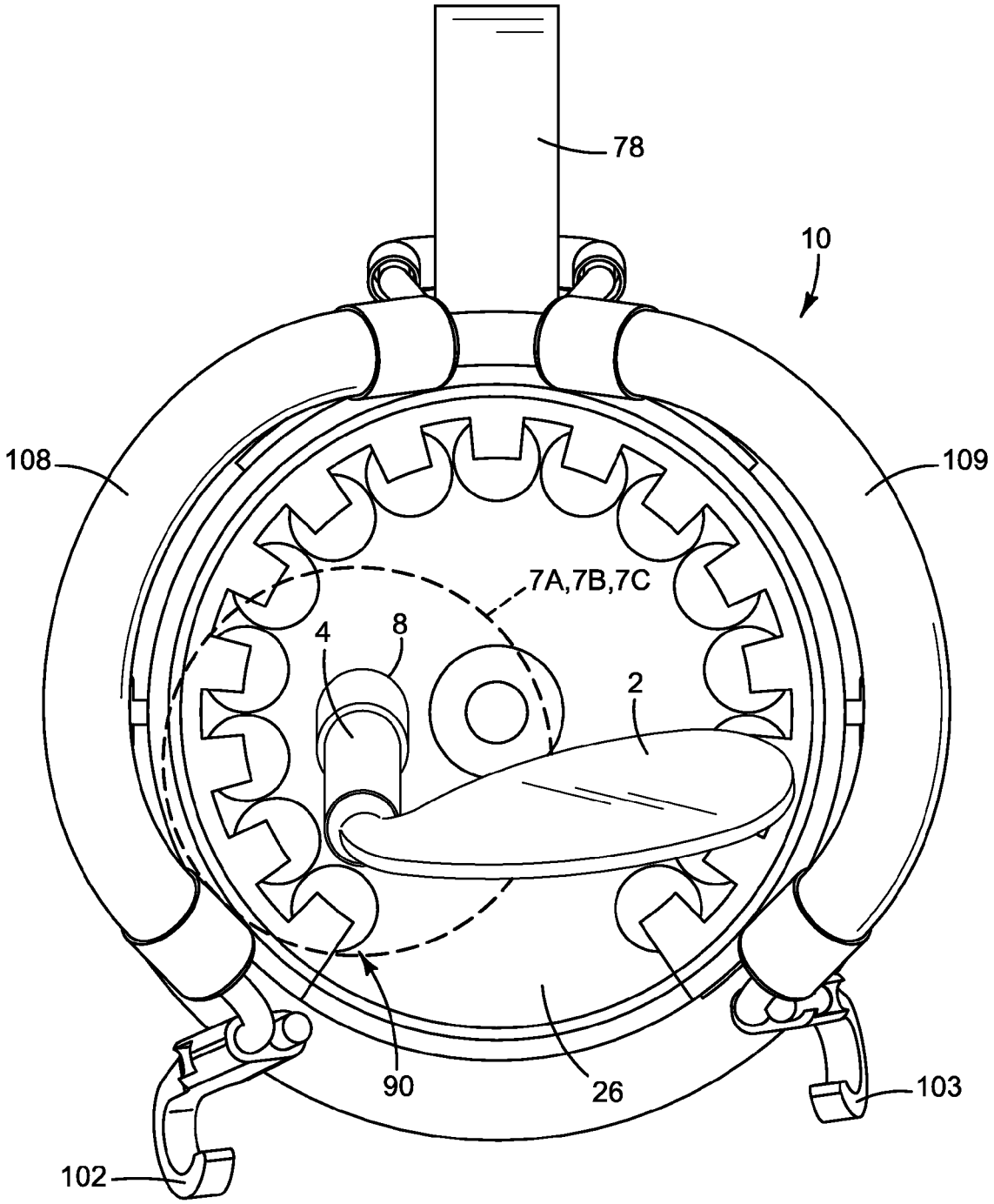
FIG. 7 is a plan view of the first exemplary system of FIG. 1, as further shown in FIG. 5, showing the insertion of a golf club therein.
Figure 7A:
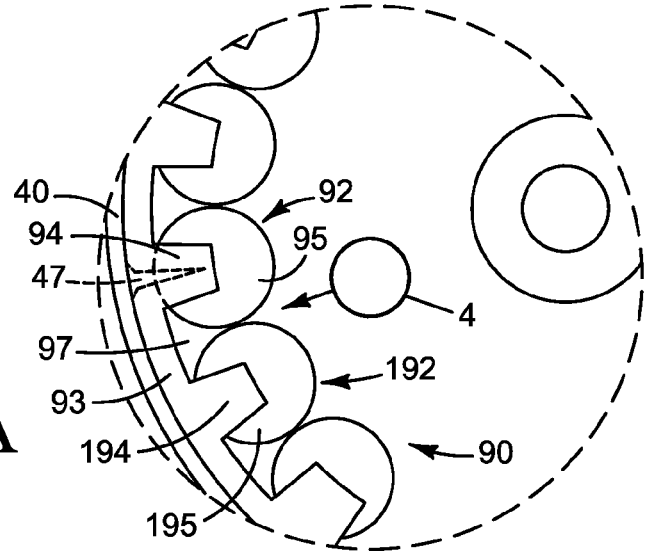
FIG. 7A is a partial plan view of the view illustrated in FIG. 7.
Figure 7B:
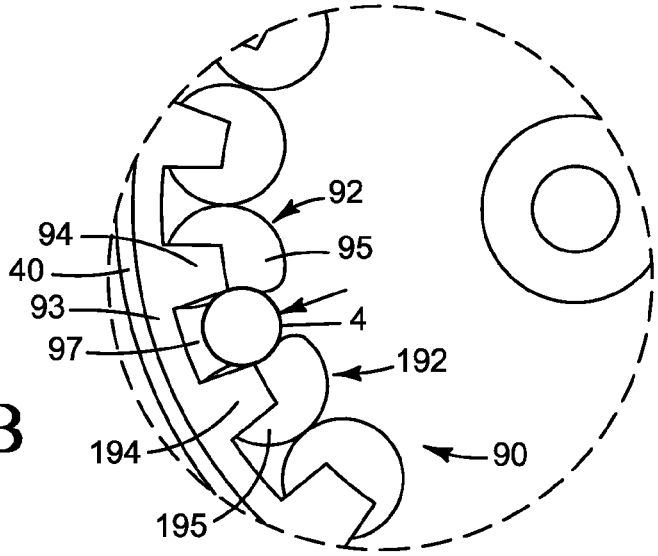
FIG. 7B is a partial plan view of the view illustrated in FIG. 7.
Figure 7C:
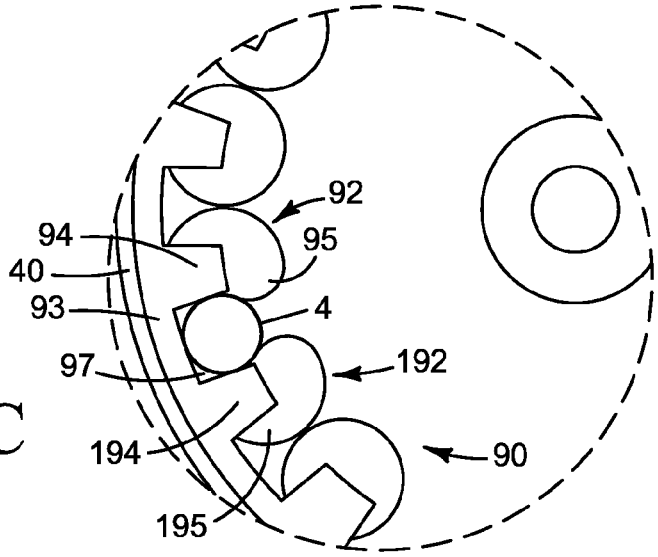
FIG. 7C is a partial plan view of the view illustrated in FIG. 7.

FIG. 7A illustrates a shaft 4 not being held by the horizontal shaft spacer portion 90. In FIG. 7B, the shaft 4 is inserted between the first shaft retainer module 92 and the second shaft retainer module 192. The compressible planar discs (95, 195) are shown compressing as the shaft 4 is inserted towards the recess 97. In FIG. 7C, the shaft 4 is inserted further into the recess 97, with the compressed compressible planar discs (95, 195) holding the shaft 4 within the recess 97.

The connection system 101 is for connecting the system to an object 9 such as a golf cart. Modern golf club bags are reliant on strapping systems which are provided on golf carts in order to secure them to a golf cart. These strapping systems wrap around the bag. When the system is utilized with such an existing golf cart strapping system, the strap would cross the opening 42. To overcome this issue, in the connection system 101 comprises a first support strap 104 attached to the body portion 20 at a first connection point 106 via a first connection means adjacent a first side of the system, and a second support strap 105 attached to the body portion 20 at a second connection point 107 via a second connection means adjacent a second side of the system. The first support strap 104 comprising a connector 102 for connecting with the object 9 at a first side 11 at a first connection point, the second support strap 105 comprising a connector 103 for connecting with the object 9 at a second side 12 at a second connection point.

The length of the first support strap 104 and second support strap 105 adjustable so as to allow the system to be releasably fixed to the object 9. An example of one manner of adjusting the length of the support straps is illustrated in the Figures, namely the support straps 104, 105 having a connector 102 for connecting with the back plate 80. The connection system 101 connecting with the back plate 80 via connector 102, connector 102 able to latch onto the body 81 at a connector 82 via a hook portion 110. The back plate 80 illustrated in FIG. 13 having four connectors (82, 182 183, 184). By varying the connector 82 utilized, the length of the support straps 104, 105 can be varied. In the exemplary connection system 101 illustrated in FIG. 13, the connector 102 further comprising a flange 98 for connecting with an adjacent connector on the body 81, such as the second connector 182. The flange 98 for limiting unintentional movement of the connector 102 when connected to the body 81, thereby decreasing the chances that the connection system 101 will unintentionally detach from whatever it is affixed to.

The support straps 104, 105 illustrated in the Figures comprising the two ends of the same support strap. Because the support straps 104, 105 comprise the same support strap, the length of the first strap 104 can be adjusted to be longer than the second support strap 105, if so desired. In other exemplary systems, the support straps may comprise separate support straps which may or may not be connected together.

The connection system 101 comprising a first tubular guide 108 and a second tubular guide 109, the tubular guides attached to the retention ring 72. The tubular guides following the outer circumference near the open top portion 30 of the system. The tubular guides for guiding the support straps from their connection with the back plate to the opening side of the system. It is preferred that the tubular guides be installed with voids between the body portion and the tubular guides, thereby allowing the tubular guides to be used as handles.

In another exemplary system, the first support strap connects to a first side of the retention ring, and the second support strap connects to a second side of the retention ring, whereby a separate means for shortening/lengthening the support straps is provided.

FIGS. 10, 11, 19, and 22 illustrate the attachment of an external club holder tube 85 to the outside surface of the system 100, preferably on the same side as the shroud cover 62. The external club holder tube 85 can be removed and placed on the other side of the opening, if so desired.

The external club holder tube 85 comprising an upper portion 88 rotatably attached to a lower portion 86. The lower portion 86 stationary, comprising a connection for connecting with the system. It is preferred that the upper portion 88 be configured for insertion into the lower portion 86 in a manner that allows the upper portion 88 to turn or rotate within the lower portion 86. The upper portion 88 comprising an opening 87 for receiving the end portion of a device 2 having an elongated shaft 4. The upper portion 88 further comprising a connector 89 for connecting with the shank portion of the device 2. Preferably, the connector 89 is configured like the horizontal shaft spacer portion 90. After the end portion is inserted into the opening, the upper portion 88 can be rotated relative to the lower portion 86, thereby covering the opening and securing the end portion of the device therein. It is preferred that the lower portion comprises an inverse cone at the bottom that serves to secure the bottom of the end portion 8. The upper portion 88 can also turn in a fashion that would turn the opening 87 of the tube toward the body portion 20 thereby reducing the chance that the shaft 202 could fall out.

The cover portions can alternatively be "flipped" (in comparison to what is illustrated in FIG. 1) and installed on the body portion so that the opening can be closed in the opposite direction, as illustrated in FIG. 23. The exemplary system 300 of FIG. 23 having a body portion 120 and at least one cover portion 150. The body portion 120 comprising a closed bottom portion 122 connected to an open top portion 130 via a sidewall portion 140. The space between the closed bottom portion 122 and the open top portion 130 defining an interior chamber.

An opening 142 is defined through the sidewall portion 140. In the exemplary system shown, the opening 142 extends from the open top portion 130 towards the closed bottom portion 122. The Figure showing an open-topped opening 142 having a pair of generally vertical sides (first side 141 opposite second side 143) and a generally horizontal bottom side 145. Other configurations and shapes of openings could be used.

The cover portion 150 is for covering (closing) the opening 142. The cover portion 150 illustrated in these Figures having a generally open-ring or "arc" shape. The cover portion 150 having an open position and a closed position. The cover portion 150 closing at least a portion of the opening 142 when the cover portion 150 is in its closed position. The cover portion 150 spaced apart from the opening 142 (not closing) when the cover portion 150 is in its open position.

In the system 300 illustrated in FIG. 23, three cover portions 150, 152, 154 are utilized. The cover portion 150 does not vertically cover the entire opening 142. A second cover portion 52 and a third cover portion 54 are provided for working with the cover portion 150 to cover the opening 142. Each of the plurality of cover portion (150, 152, 154) close at least a portion of the opening 142 when in the closed position. While this Figure illustrates the use of three cover portions, other embodiments may have one, two, or more cover portions.

The cover portions 150, 152, 154 illustrated in this Figure each comprising a handle 151. The handle 151 for enabling a user to move the cover portion (150, 152, 154) from its closed position to the open position. Other types and forms of handles could be utilized. Such a handle 151 is optional.

In another exemplary system, the device comprises a baseball bat.

In another exemplary system, the device comprises a fishing pole.

Any suitable structure and/or material can be used for the components of the system, and a skilled artisan will be able to select an appropriate structure and material for the system in a particular embodiment based on various considerations, including the intended use of the system, the intended arena within which the system will be used, and the equipment and/or accessories with which the system is intended to be used, among other considerations.

The inventor has determined that conventional polymeric and metal materials are suitable for use in the various components of the system. For example, the body portion, cover portion, center spacer portion, and associated components can be injection-molded from suitable plastics known in the art, including material having low friction characteristics that are rigid. For example, the horizontal shaft spacer portion, and associated components can be formed from resilient and/or compressible materials. For example, the support straps could be elastic cord, or non elastic material (e.g., cord, wire, strapping). Materials hereinafter discovered and/or developed that are determined to be suitable for use in storage devices/systems would also be considered suitable for use in a system according to a particular embodiment.

It is noted that all structure and features of the various described and illustrated embodiments can be combined in any suitable configuration for inclusion in a system according to a particular embodiment. For example, a system according a particular embodiment can include neither, one, or both of a side opening/cover portion and a center spacer portion described above. For example, a system according a particular embodiment can include neither, one, or both of a side opening/cover portion and a horizontal shaft spacer portion described above. For example, a system according a particular embodiment can include neither, one, or both of a horizontal shaft spacer portion and a center spacer portion described above. For example, a system according a particular embodiment can include neither, one, or both of a side opening/cover portion and a connection system described above. For example, a system according a particular embodiment can include neither, one, or both of a connection system and a horizontal shaft spacer portion described above. For example, a system according a particular embodiment can include neither, one, or both of a connection system and a center spacer portion described above.

Furthermore, a system according to a particular embodiment can include the center spacer portion and one or more of the cover portion, the horizontal shaft spacer portion, and the connection system described above, in combination with one or more of the center spacer portion, the cover portion, the horizontal shaft spacer portion, and the connection system described above.

Furthermore, a system according to a particular embodiment can include the cover portion and one or more of the center spacer portion, the horizontal shaft spacer portion, and the connection system described above, in combination with one or more of the center spacer portion, the cover portion, the horizontal shaft spacer portion, and the connection system described above.

Furthermore, a system according to a particular embodiment can include the horizontal shaft spacer portion and one or more of the cover portion, the center spacer portion, and the connection system described above, in combination with one or more of the center spacer portion, the cover portion, the horizontal shaft spacer portion, and the connection system described above.

Furthermore, a system according to a particular embodiment can include the connection system and one or more of the cover portion, the horizontal shaft spacer portion, and the center spacer portion described above, in combination with one or more of the center spacer portion, the cover portion, the horizontal shaft spacer portion, and the connection system described above.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A system for storing a device having an elongated shaft and a shank portion, said system comprising a body portion and a cover portion, wherein:

said body portion generally cylindrical in shape defining a first circumference having a first center axis, said generally cylindrical body portion comprising an open top portion, a closed bottom portion, and a sidewall portion extending between said open top portion and said closed bottom portion, said sidewall portion defining an opening there-through extending from said open top end portion towards said closed bottom end portion, and said cover portion having a generally open-ring shape defining a second circumference having a second center axis, said second circumference larger than said first circumference, said cover portion slid onto said body portion thereby circumscribing said body portion with said second center axis aligned with said first center axis, said cover portion having an open position and a closed position, said cover portion closing at least a portion of said opening when in said closed position, said cover portion spaced apart from said opening when in said open position.

2. The system of claim 1, wherein said cover portion comprises a plurality of cover portions, wherein each of said plurality of cover portions close at least a portion of said opening when in said closed position.

3. The system of claim 1, wherein said cover portion is configured to rotate concentrically around the body portion.

4. The system of claim 1, wherein said sidewall portion is generally circular in shape vertically below said opening, and generally arc-shaped vertically along said opening's vertical height.

5. The system of claim 1, wherein said system further comprises a support element for supporting the body portion, said support element connecting to said bottom portion of said body portion, said support element extending away from said bottom portion.

6. The system of claim 5, further comprising a back plate connecting with said support element.

7. The system of claim 1, wherein said body portion further comprises a horizontal shaft spacer portion adjacent said open top end portion.

8. The system of claim 7, wherein said horizontal shaft spacer portion comprises shaft engaging means configured for receiving and retaining the shank portion of an elongated shaft.

9. The system of claim 8, wherein said horizontal shaft spacer portion comprises a series of retainer modules, each retainer module comprising an upper retainer, a bottom retainer, and a compressible planar disc received between said upper retainer and said bottom retainer.

10. The system of claim 1 further comprising:

said sidewall portion comprising an interior sidewall surface, said closed bottom portion comprising an interior base surface, said interior base surface comprising an upwardly extending a center spacer portion, said center spacer portion having a center surface, said center surface spaced apart from said interior sidewall surface and defining a retention channel there-between, wherein said end portion can be inserted into said body portion and into said retention channel, held spaced apart from and above the closed bottom by a friction fit between the interior sidewall surface and said center surface.

11. The system of claim 10, wherein said center spacer portion has a generally curved cross-sectional shape, a generally conical cross-sectional shape, or a generally frusto-conical cross-sectional shape.

12. The system of claim 10, wherein said system further comprises a support element and a back plate, said support element for supporting the body portion, said support element connecting to said closed bottom portion, said support element extending away from said closed bottom portion, and said back plate connecting with said support element.

13. The system of claim 10, wherein the end portion has a diameter, wherein the diameter of the end portion defines the distance said end portion is held spaced apart from and above the closed bottom portion.

14. A system for storing a device having an elongated shaft and a shank portion, said system comprising a body portion and a cover portion, wherein:

said body portion generally cylindrical in shape, said body portion comprising a closed bottom end portion connected to an open top end portion via a sidewall portion, said sidewall portion defining an opening there-through extending from said open top end portion towards said closed bottom end portion, and said body portion generally cylindrical in shape defining a first circumference having a first center axis, said generally cylindrical body portion comprising an open top portion, a closed bottom portion, and a sidewall portion extending between said open top portion and said closed bottom portion, said sidewall portion defining an opening there-through extending from said open top end portion towards said closed bottom end portion, and said cover portion having a generally open-ring shape defining a second circumference having a second center axis, said second circumference larger than said first circumference, said cover portion slid onto said body portion thereby circumscribing said body portion with said second center axis aligned with said first center axis, said cover portion having an open position and a closed position, said cover portion closing at least a portion of said opening when in said closed position, said cover portion spaced apart from said opening when in said open position, wherein the cover portion is arranged concentric to the body portion so that the cover portion is configured to rotate concentrically relative to the body portion; wherein said body portion further comprises a horizontal shaft spacer portion adjacent said open top end portion; wherein said horizontal shaft spacer portion comprises shaft engaging means configured for receiving and retaining the shank portion of an elongated shaft; and wherein said horizontal shaft spacer portion comprises a series of retainer modules, each retainer module comprising an upper retainer, a bottom retainer, and a compressible planar disc received between said upper retainer and said bottom retainer.

* * * * *